US009759217B2

(12) United States Patent
Yokota et al.

(10) Patent No.: US 9,759,217 B2
(45) Date of Patent: Sep. 12, 2017

(54) SELF-PRIMING CENTRIFUGAL PUMP

(75) Inventors: Hiroshi Yokota, Hiroshima (JP); Fumio Nishi, Hiroshima (JP); Isao Kawamoto, Hiroshima (JP); Kenji Takahashi, Hiroshima (JP)

(73) Assignee: KABUSHIKI KAISHA YOKOTA SEISAKUSHO, Hiroshima-shi (JP)

( * ) Notice: Subject to any disclaimer, the term of this patent is extended or adjusted under 35 U.S.C. 154(b) by 832 days.

(21) Appl. No.: 14/233,948

(22) PCT Filed: Aug. 9, 2012

(86) PCT No.: PCT/JP2012/070776
§ 371 (c)(1),
(2), (4) Date: Jan. 21, 2014

(87) PCT Pub. No.: WO2013/022121
PCT Pub. Date: Feb. 14, 2013

(65) Prior Publication Data

US 2014/0169940 A1 Jun. 19, 2014

(30) Foreign Application Priority Data

Aug. 11, 2011 (JP) ..... 2011-175852

(51) Int. Cl.
*F03B 11/04* (2006.01)
*F04D 9/02* (2006.01)
(Continued)

(52) U.S. Cl.
CPC ..... *F04D 9/02* (2013.01); *F04D 1/04* (2013.01); *F04D 9/005* (2013.01); *F04D 9/007* (2013.01)

(58) Field of Classification Search
CPC . F04D 9/02; F04D 9/005; F04D 9/007; F04D 1/04
(Continued)

(56) References Cited

U.S. PATENT DOCUMENTS 3,125,030 A 3/1964 Yokota et al.
4,565,489 A * 1/1986 Haide ..... F04D 9/02 415/56.1
(Continued)

FOREIGN PATENT DOCUMENTS

JP 28-772 1/1953
JP 28772 Y1 * 1/1953
(Continued)

OTHER PUBLICATIONS

International Preliminary Report on Patentablity dated Feb. 11, 2014, in the corresponding international patent application No. PCTYS2012001, with the Notification of Transmittal of Copies of Translation of the International Preliminary Report on Patentability (Chapter I or Chapter II), dated Feb. 20, 2014.

*Primary Examiner* — Jason Shanske
*Assistant Examiner* — Kelsey Stanek
(74) *Attorney, Agent, or Firm* — Kratz, Quintos & Hanson, LLP

(57) ABSTRACT

A pump with high performance and cleanability includes a casing having a smaller volute and a larger volute; a space between an outer circumference of an impeller and a starting end of the smaller volute being greater than that of the larger volute, generating a circulating flow of self-priming water from the smaller volute to the larger volute; and a diffusing part of the larger volute being formed into an upright, cylindrical self-priming water separating chamber guiding the self-priming water from the smaller volute to flow in for air-water separation. An inner circumference part of the casing is formed concentric with the outer circumference of the impeller with a predetermined space therebetween; defining members are protrusively disposed on the inner circumference part of the casing so as to define the shapes of the two volutes; and the self-priming water separating
(Continued)

chamber is made attachable to and detachable from the casing.

20 Claims, 22 Drawing Sheets

(51) Int. Cl.
*F04D 9/00* (2006.01)
*F04D 1/04* (2006.01)

(58) Field of Classification Search
USPC ..... 415/56.1, 53
See application file for complete search history.

(56) References Cited

U.S. PATENT DOCUMENTS 4,934,914 A * 6/1990 Kobayashi ..... F04D 9/005
137/533.11
5,772,394 A 6/1998 Yokota et al.

FOREIGN PATENT DOCUMENTS

| | | |
|---|---|---|
| JP | 28-3039 | 6/1953 |
| JP | 29-3025 | 5/1954 |
| JP | 29-6490 | 10/1954 |
| JP | 38-15529 | 8/1963 |
| JP | 50-21682 | 7/1975 |
| JP | 02-163493 | 6/1990 |
| JP | 06-280778 | 10/1994 |
| JP | 07-001037 B | 1/1995 |
| JP | 2630725 | 4/1997 |
| JP | 2007-327393 | 12/2007 |

* cited by examiner (A)

(B)

(A)

(B)

(A)

(B)

(A)

(B)

(C)

(A)

(B)

(C)

(A)

(B)

(A)

(B)

(A)

(B)

PRIOR ART

SELF-PRIMING CENTRIFUGAL PUMP

TECHNICAL FIELD

The present invention relates to a self-priming centrifugal pump to be applied to automatic operative systems capable of serving for highly reliable automatic pumping and automatic water conveying in various industrial fields, having a simple construction, capable of economical operation with excellent self-priming performance and pumping performance, and is easy to clean or disassemble meeting sanitary specifications.

In the specification, the statement of claims and the abstract herein, "water" is a generic term for a liquid, and "air" is a generic term for a gas.

BACKGROUND ART

A conventional centrifugal pump for pumping up water is provided with a device, such as a vacuum pump, necessary only for priming. Likewise, various self-priming pumps invented to overcome disadvantages in conventional pumps of such a type are provided unavoidably with a device necessary only for priming, such as a self-priming water tank or an air separator tank.

The present invention relates to improvements in the self-priming centrifugal pumps typically disclosed in Patent Document 1-3 (hereinafter referred to as "Original Invention 1-3" respectively).

The centrifugal pump unit of each of those Original Inventions is characterized by a common passage that serves as both a priming water circulating passage during self-priming operation and a discharge passage during normal pumping operation, which is a distinctive feature of the pump unit of those Original Inventions which is not found in previously known various self-priming centrifugal pumps. And, the pumps of those Original Inventions, with further improvements to accommodate various operating conditions, have shown excellent self-priming and pumping performance.

For instance, the principle of self-priming action that circulates self-priming water by the characteristics of a larger volute and a smaller volute to drive out an air-water mixture produced by vortices generated around rotating impeller blades is elucidated in Original Invention 1. In Original Invention 2, the pump is further improved to attain higher self-priming performance by making the self-priming water rotate so that the air-water mixture is forcibly separated into air and water by centrifugal separation, and by providing a "cavity holder" which holds a tail bottom of a tornado-shaped cavity caused by the rotation of the self-priming water, preventing it from extending and being sucked into the volute of the pump. And, in Original Invention 3, it is intended to solve a remaining problem of an increased resistance of the flow passages caused by the cavity holder. A spiral guide is incorporated in the volute passage in order to suppress the rotation of the self-priming water after the centrifugal separation is finished, so that the cavity holder can be omitted, whereby it is intended to achieve an enhancement of the self-priming performance and a reduction of the resistance of the passage at the same time.

As exemplified in FIG. 22, the structure of the pump according to Original Invention 3 includes a smaller volute v1 and a larger volute v2, formed at diametrically opposite positions in a pump casing 1. A passage area of a spouting passage c2 of the larger volute v2 increases its cross section gradually towards a discharge passage h and forms a self-priming water separating chamber e of an upright cylindrical shape. A spouting passage c1 of the smaller volute v1 extends in a curve and merges substantially tangentially into that chamber e. And, a spiral guide 41, formed in a shape to suppress and substantially counterbalance the momentum of the whirling current of the self-priming water coming from the smaller volute v1, is provided on an inner wall of the lower part of the chamber e towards the spouting passage c2 of the larger volute v2. Meanwhile, a space s1 between an outer circumference of an impeller 4 and the smaller volute v1 at the position from which the smaller volute v1 extends is greater than a space s2 between the outer circumference of the impeller 4 and the larger volute v2 at the position from which the larger volute v2 extends.

At the start of the operation of this pump, a necessary amount of water is supplied into the pump and the impeller 4 is rotated. Consequently, the water is accelerated by the impeller 4 and flows mostly into the smaller volute v1. The water is then spouted through the spouting passage c1 into the self-priming water separating chamber e. Thus, the water supplied into the pump circulates through a circulating passage 4-->v1-->c1-->e-->c2-->v2-->4, and this circulating water draws in air prevailing around the central portion of the impeller 4 to change it into water containing bubbles, i.e., an air-water mixture, which is spouted into the chamber e. This self-priming water (air-water mixture) spouted into the chamber e flows in a whirling current along the surface of the inner wall of the chamber e, and owing to a centrifugal separating effect, the bubbles instantly form a tornado-like cavity t having a shape of an inverted circular cone in the central region of the chamber e. And, because the spiral guide 41 to suppress the momentum of the whirling current of the self-priming water is provided at the point where the whirling current just after finishing the centrifugal separation is about to pass by, the cavity is disrupted at that point and therefore the cavity is prevented from being sucked into the larger volute v2. The centrifuged air is gradually discharged to the outside of the pump, and thus the self-priming action is completed before long. After the normal pumping condition is established, the smaller volute v1, the larger volute v2, and the self-priming water separating chamber e form a normal passage of a centrifugal pump for satisfactory pumping.

Thus, the pumps according to Original Invention 1-3 are extremely practical and useful as self-priming centrifugal pumps with excellent self-priming performance and pumping performance, however, the following problems still remain unsolved in some applications. That is, in applications for the treatment of clean or a high-purity liquid, such as food, pure water, high-purity chemicals or medicinal chemicals, there is the problem of insufficient cleanability, either when the cleaning system is CIP (Cleaning In Place: internal cleaning without disassembly) or COP (Cleaning Out of Place: disassembled cleaning).

Normally, an apparatus used for the above purposes requires, as "sanitary specifications", not only a flat and smooth wetted surface, but also a structure in which easy CIP, COP, and reassembly can be performed. However, with the structures of the pumps according to Original Invention 1-3, disassembly is difficult, and CIP of wet areas without leaving any shadows is also difficult.

In the pump according to Original Invention 1, the pump has a rather complicated structure including two volutes, large and small, causing difficulties in disassembly work. Its flow passages are also rather complicated, causing difficulties in CIP (Cleaning In Place) of wet areas without leaving any shadows.

In the pump according to Original Invention 2, the problem of the insufficient cleanability has not been resolved in any way. There is, instead, the occurrence of new shadows or bottlenecks hard to clean, such as the one on the back side of the cavity holder, which is caused by introducing the cavity holder to enhance self-priming performance. The system is not always applicable to various kinds of liquids because there is a possibility of clogging due to the bottleneck if particles or masses are mixed in the liquid such as food material.

And, in the pump according to Original Invention 3, while the above-mentioned cavity holder is removed, the spiral guide introduced as a substitute for the cavity holder has many local concavities and convexities, and thus the problem of the insufficient cleanability has not been resolved in any way.

It is widely accepted, in the first place, that forming component parts by casting is the most efficient way to manufacture an apparatus of such a complicated construction. Accordingly, the existence of rough surfaces and blow holes due to the casting process also becomes a major obstacle to the cleanability of the apparatus.

Generally, in a conventional type pump, a pump casing is made by casting in one piece including a volute and a discharging diffuser. As regards the contamination of liquid to be pumped due to particulates dissolving out from minute defects on the casting surface, such contamination is tolerated in a field where a liquid of comparatively low purity level is used. And, in a system where high purity level is required for the liquid handled, such as food and an ultrapure water system, the entire wetted surfaces of the cast component parts are finished by polishing and precision cleaning in an attempt to reduce contamination to a minimum. However, such measures to avoid contamination is not perfect, and, unsolved problems, such as particulates dissolving out, still reside therein.

These problems are caused inevitably due to the structure of Original Invention 1-3, and from a technical perspective pose difficulty in solving. Foremost, if the improvement of various performance as a pump is the main focus, the structural composition of its flow passages tends to become complicated, with the trade-off being insufficient cleanability. Therefore, resolving the aforementioned two problems, that is "self-priming and pumping performance" and "ease of cleaning" at the same time seemed a difficult challenge.

DOCUMENTS OF PRIOR ART

Patent Documents

Patent Document 1: JP, S28-3039, B (Original Invention 1)

Patent Document 2: JP, S50-21682, B (Original Invention 2)

Patent Document 3: Japanese Patent No. 2630725 (Original Invention 3)

SUMMARY OF THE INVENTION

Problems to be Solved by the Invention

An object of the present invention is to solve those technical problems in the prior art, and to provide a self-priming centrifugal pump with enhanced performance and easy operation in a simple mechanism with safe and assured operation, free from restrictions attributable to the quality of a liquid to be pumped and from being blocked, capable of exerting high self-priming performance and high pumping-up performance when being applied to an automatic operative system which handles clean or a high-purity liquid, such as food, pure water, high-purity chemicals or medicinal chemicals, facilitating easy cleaning with CIP (Cleaning In Place) and COP (Cleaning Out of Place) ability that meets sanitary specifications, and enabling application to various kinds of liquids.

Means for Solving the Problems

To attain the above object, the self-priming centrifugal pump according to the present invention comprises:

a pump casing having a smaller volute and a larger volute;

a space being formed between an outer circumference of an impeller and a starting end of the smaller volute, said space being greater than a space between the outer circumference of the impeller and a starting end of the larger volute, generating a circulating current of self-priming water flowing from the smaller volute to the larger volute;

a diffusing part of the larger volute being formed into an upright, cylindrical self-priming water separating chamber into which the current of the self-priming water from the smaller volute is guided to flow so that air-water separation of the self-priming water is carried out in the self-priming water separating chamber:

characterized in that an inner circumference part of the casing is formed in a circular shape concentric with the outer circumference part of the impeller with a predetermined interval therebetween, and, in the annular space formed between the inner circumference part of the casing and the outer circumference part of the impeller, defining members are disposed on the inner circumference part of the casing so as to be protruded inward toward the vicinity of the outer circumference part of the impeller whereby the defining members define the shapes of the smaller volute and the larger volute; and respective passages from the smaller volute and the larger volute toward the self-priming water separating chamber are respectively separated into connectable members whereby the self-priming water separating chamber is enabled to be attached to and detached from the casing.

In the present invention, an opening part of a spouting passage of the smaller volute, opened toward the self-priming water separating chamber, may be formed in a flow path that is drawn substantially tangentially into the self-priming water separating chamber so that the self-priming water flowing from the smaller volute into that chamber generates a whirling current for centrifugal air-water separation;

an opening part of a passage from the larger volute, opened toward the self-priming water separating chamber, may be formed in a flow path that is drawn substantially tangentially into the self-priming water separating chamber;

the self-priming water separating chamber may be formed into a bottomed cylindrical shape, the vicinity of the center of the bottom of that chamber being positioned lower than the lower end of the cross section of the opening part of the passage from the larger volute opened toward the self-priming water separating chamber;

the self-priming water separating chamber may be formed such that its inner wall has no concavo-convex part including a bottleneck, a guide, a baffle plate, and a protrusion;

the self-priming water flowing from the smaller volute may be partially branched before reaching the opening part of the spouting passage of the smaller volute, this branched flow flowing out into the self-priming water separating chamber through an opening part of a branch flow passage separately provided at a height position nearly equal to or higher than that of the opening part of the spouting passage of the smaller volute;

a flow rate of the partially branched flow of the self-priming water flowing from the smaller volute may be made adjustable;

an outflow direction of the branched flow flowing out into the self-priming water separating chamber through the opening part of the branch flow passage may be set so as to suppress the whirling motion of the self-priming water flowing out into the self-priming water separating chamber through the opening part of the spouting passage of the smaller volute;

the self-priming water separating chamber may be formed such that its inner wall is not constant in the dimension of a diameter;

a reduced diameter part may be provided in a discharge passage of the self-priming water separating chamber;

a cleaning fluid inlet may be provided on the upper part of the self-priming water separating chamber;

a cleaning fluid inlet may be provided near a shaft sealing part of the casing where a rotating shaft of the impeller penetrates;

the cleaning fluid inlet near the shaft sealing part of the casing may be enabled to communicate with the vicinity of the inner circumference part of the casing or with the vicinity of the self-priming water separating chamber;

the pump may be configured such that a suction inlet of the pump is disposed at the side of a drive machine when viewed from the side of the impeller; and the suction inlet of the pump may be configured such that a portion of a suction pipe connected to the pump is raised in a curved section so that the lower end of the cross section of the highest portion of the curved section is at a level nearly equal to or above the upper end of the impeller.

Effect of the Invention

Because of such constitution, the pump according to the present invention exhibits excellent self-priming performance and pumping performance, and can fully meet sanitary specifications because all the component parts of the pump can be finished by polishing and precision cleaning, wet areas of the pump can be cleaned without leaving any shadows during CIP (Cleaning In Place), and easy COP (Cleaning Out of Place) and reassembly is also facilitated. The pump is applicable to various kinds of liquids such as pure water, high-purity liquid, and liquid containing various particles or liquid having viscosity including food and chemicals.

BRIEF DESCRIPTION OF THE DRAWINGS

FIG. 4 (B) is a sectional view taken along the line I-I in FIG. 4 (A).

FIG. 4 (C) is a sectional view taken along the line II-II in FIG. 4 (A).

FIG. 5 (B) is a sectional view taken along the line II-II in FIG. 5 (A).

FIG. 6 (B) is a sectional view taken along the line II-II in FIG. 6 (A).

FIG. 8 (B) is a sectional view taken along the line I-I in FIG. 8 (A).

FIG. 8 (C) is a sectional view taken along the line II-II in FIG. 8 (A).

FIG. 9 (B) is a sectional view taken along the line II-II in FIG. 9 (A).

FIG. 10 (B) is a sectional view taken along the line II-II in FIG. 10 (A).

FIG. 11 (B) is a sectional view taken along the line I-I in FIG. 11 (A).

FIG. 12 (B) is a sectional view taken along the line I-I in FIG. 12 (A).

FIG. 14 (B) is a sectional view taken along the line I-I in FIG. 14 (A).

FIG. 14 (C) is a sectional view taken along the line II-II in FIG. 14 (A).

FIG. 15 (B) is a sectional view taken along the line I-I in FIG. 15 (A).

FIG. 15 (C) is a sectional view taken along the line II-II in FIG. 15 (A).

FIG. 16 (B) is a sectional view taken along the line II-II in FIG. 16 (A).

FIG. 17 (B) is a sectional view taken along the line I-I in FIG. 17 (A).

FIG. 18 (B) is a sectional view taken along the line I-I in FIG. 18 (A).

FIG. 22 (B) is a sectional view taken along the line I-I in FIG. 22 (A).

DESCRIPTION OF THE PREFERRED EMBODIMENTS

Each embodiment of the present invention will be explained in detail using the same reference symbols that are common to each figure.

First Embodiment

Figure 1:
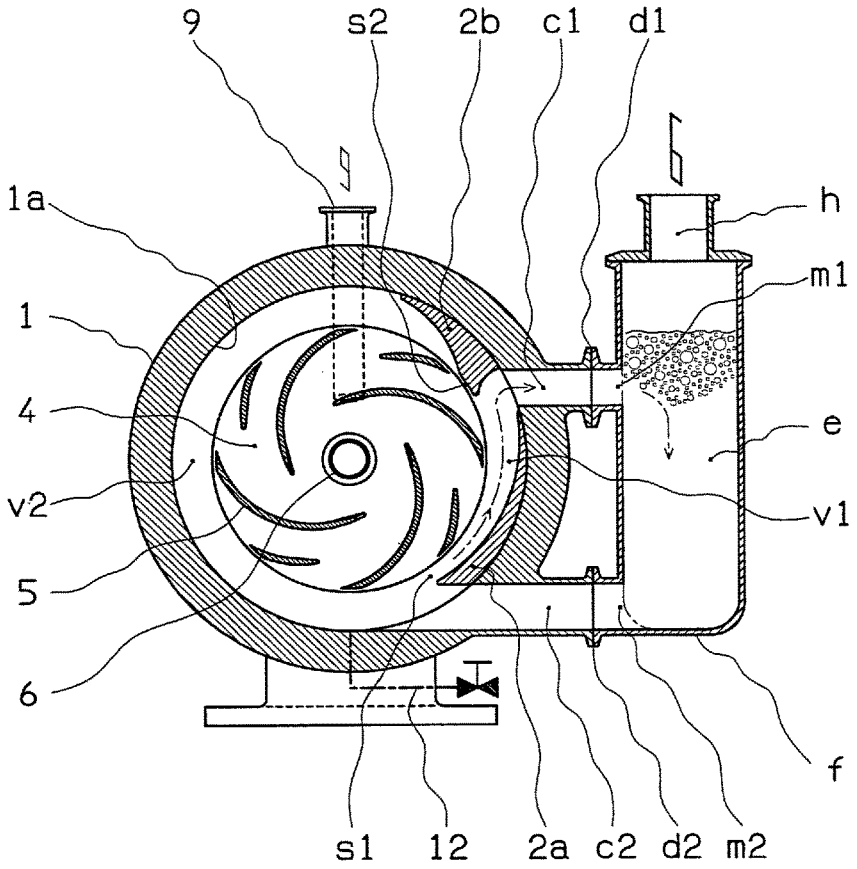
FIG. 1 is a cross-sectional view of the first embodiment of the present invention.
Figure 2:
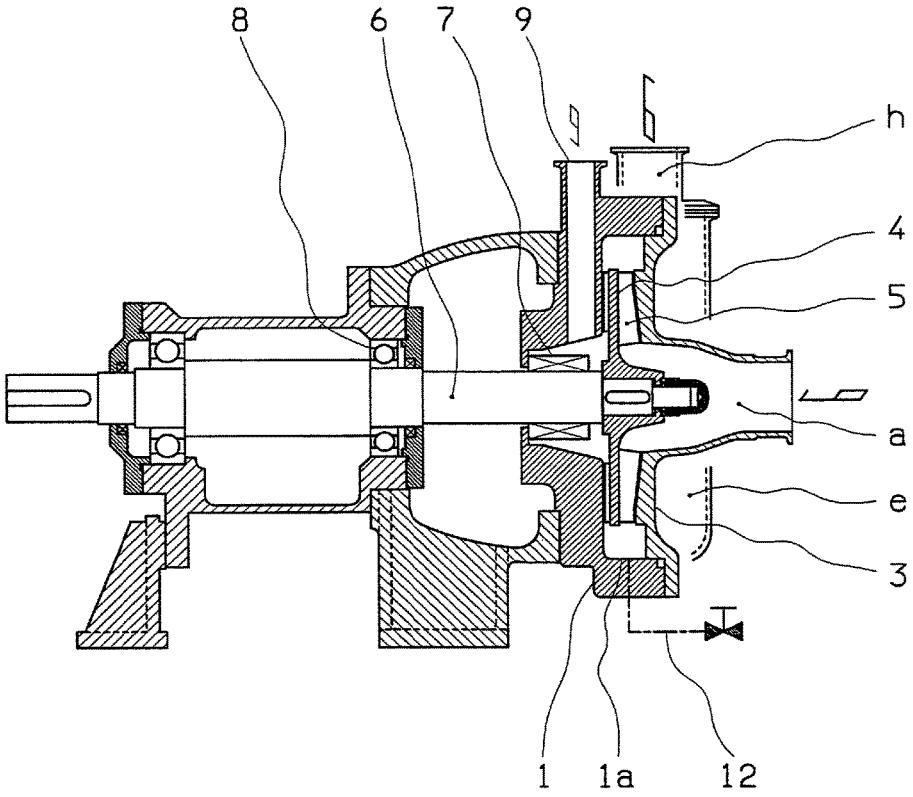
FIG. 2 is a longitudinal sectional view of the first and the second embodiments of the present invention.

FIG. 1 shows a cross-sectional view of the first embodiment of the present invention, and FIG. 2 shows a longitudinal sectional view of this first embodiment.

Shown in FIG. 1 and FIG. 2 are a casing 1, an inlet cover 3, an impeller 4, impeller blades 5, a rotating shaft 6, a shaft sealing part 7, a bearing part 8, an inlet passage a and a discharge passage h. A smaller volute v1 opening up and a larger volute v2 opening down are formed at diametrically opposite positions, respectively, in the casing 1. The smaller volute v1 extends from a position at a level below that of the suction opening of the impeller 4, and the larger volute v2 extends from a position at a level above that of the suction opening of the impeller 4. A space s1 between the outer circumference of the impeller 4 and the smaller volute v1 at the position from which the smaller volute v1 extends is made greater than a space s2 between the outer circumference of the impeller 4 and the larger volute v2 at the position from which the larger volute v2 extends, whereby a circulating current of self-priming water reserved in the pump flowing from the smaller volute v1 to the larger volute v2 is generated during a self-priming operation.

The passage area from a passage c2 toward the discharge passage h of the larger volute v2, namely a diffusing part of the larger volute v2, forms a self-priming water separating chamber e of an upright cylindrical shape. A spouting passage c1 of the smaller volute v1 merges into the self-priming water separating chamber e so as to guide the self-priming water to flow out into that chamber e, where air-water separation is carried out. As illustrated in the figures, a reduced diameter part may be provided in the discharge passage h of the self-priming water separating chamber e so as to suppress the rising of the water level caused by a turbulent inflow of the self-priming water.

Besides the above-mentioned basic constitution as a self-priming centrifugal pump, the present invention provides an advantageous pump capable of ensuring a high-purity quality of the liquid and capable of meeting sanitary specifications by having a new constitution whereby all the wetted component parts are made of a rolled material such as a rolled (and not formed by casting) stainless steel, such components can be precisely finished by turning and grinding in an economical and easy manner, and easy cleaning with CIP (Cleaning In Place) and COP (Cleaning Out of Place) are facilitated.

An inner circumference part 1*a* of the casing 1 is formed in a circular shape concentric with the outer circumference part of the impeller 4 with a predetermined interval therebetween so that all the circumferential surfaces of the component including the wetted surfaces can be precisely finished through turning and grinding. And, in the annular space formed between the inner circumference part 1*a* of the casing 1 and the outer circumference part of the impeller 4, defining members 2*a*, 2*b* are disposed on the inner circumference part 1*a* of the casing 1 so as to be protruded inward toward the vicinity of the outer circumference part of the impeller 4, whereby the defining members 2*a*, 2*b* define the shapes of the smaller volute v1 and the larger volute v2 respectively. Namely, the shape of the smaller volute v1 is defined by the defining member 2*a*, and the shape of the larger volute v2 is defined by the defining member 2*b*. As each of the defining members 2*a*, 2*b* is formed separately from the casing 1, the precision machining and grinding work on these defining members can be easily and surely performed, and after that these defining members are fixed to the casing 1. Although these defining members may be fixed to the casing 1 by any of welding, bonding or using screws, using screws is the most desirable to facilitate the operation of disassembled cleaning. The defining members 2*a*, 2*b* may be integrated into a single member.

Furthermore, the respective passages c1, c2 from the smaller volute v1 and the larger volute v2 which lead to the self-priming water separating chamber e through respective opening parts m1, m2 are respectively separated into connectable members having respective connecting parts d1, d2, so that the self-priming water separating chamber e can be attached to and detached from the casing 1. Because of this constitution, the machining and grinding work on the parts such as the passages c1, c2, their opening parts m1, m2 toward the self-priming water separating chamber e, and the chamber bottom f, which tend to be left as shadows in conventional methods, can now be thoroughly performed in a state that the self-priming water separating chamber e is separated from the casing 1, and after that, these connectable members can be fixed to each other with a sealing in-between if necessary. Thus, according to the present invention, the precision machining and grinding work are easy and sure, and disassembled cleaning is also easy.

Sufficient interior cavity space, as exemplified in the figure, is provided near the shaft sealing part 7 where the rotating shaft 6 of the impeller 4 penetrates the casing 1, and a cleaning fluid inlet 9 leading to that cavity space is provided, so that the area can be cleaned internally without disassembling. The shape of the cavity near the shaft sealing part 7 connected to the cleaning fluid inlet 9 may be such that cleaning fluid does not readily accumulate, and in this embodiment, a cone shaped type is illustrated as an example. Preferably, if the cleaning fluid inlet 9 is disposed near a reduced diameter area of the cavity, added cleaning fluid is discharged completely from the reduced diameter area to a drain 12 at the bottom of the casing 1 via the expanded diameter area. And if the cleaning fluid inlet 9 is formed so that its passage winds tangentially into the cavity, the cleaning fluid is discharged after cleaning the entire inside of the cavity evenly, further improving the cleaning effect.

And, as exemplified in the figure, the impeller 4 is a semi-open type so as to be given the precision machining, and all the wetted component parts including this impeller 4 are designed in shapes entirely capable of being finished by the precision machining, mirror-finish grinding (buff polishing, electrolytic polishing, etc.), and precision cleaning. Moreover, these wetted component parts are designed so that pockets in which the liquid stagnates are reduced to the least possible extent to facilitate cleaning.

Function of the self-priming centrifugal pump of the present invention will be described with reference to FIG. 1 and FIG. 2 showing an embodiment of the invention. First, a necessary amount of water is supplied into the pump and the impeller 4 is rotated. Consequently, the water is accelerated by the impeller 4 and flows mostly into the smaller volute v1. The water is then spouted through the spouting passage c1 of the smaller volute v1 into the self-priming water separating chamber e. Thus, the water supplied into the pump circulates through a circulating passage 4--> v1-->c1-->e-->c2-->v2-->4. As the water circulates through the circulating passage, a vortex is generated inside the impeller 4, and the vortex draws in air prevailing around the central portion of the impeller 4 to change it into water containing bubbles, i.e., an air-water mixture, which is spouted into the self-priming water separating chamber e.

This self-priming water (air-water mixture) spouted into the self-priming water separating chamber e collides with an inner wall of the chamber e due to its own energy, and undergoes a process of spontaneous air-water separation. The air thus separated from the self-priming water flows upward and is discharged through the discharge passage h. The rising of the water level caused by a turbulent inflow of the self-priming water can be effectively suppressed through a reduced diameter part provided in the discharge passage h in the upper part of the self-priming water separating chamber e.

In the pump of the present invention, the circulating current of the self-priming water returning from the self-priming water separating chamber e to the larger volute v2 encounters the impeller 4 which is rotating in the counter direction and generating a strong reversing current. Therefore the returning water, as soon as it proceeds into the impeller blades 5, is accelerated with a strong impact given from the impeller blades 5, whereby a strong vortex is generated and air prevailing among the impeller blades 5 is effectively drawn into the circulating current. Due to this process, the amount of air separated and discharged is large for the relatively small volume of the circulating current of the self-priming water, and this pump continues the circulation of the self-priming water smoothly and effectively with sufficient discharge of air separated by the spontaneous air-water separation.

The separated air flows gradually upward and is discharged to the outside of the pump, and thus the self-priming action is completed before long. After the normal pumping condition has been established, the smaller volute v1, the larger volute v2, and the self-priming water separating chamber e serve as a normal passage of a centrifugal pump (a-->4-->v2-->c2-->e-->h and a-->4-->v1-->c1-->e-->h), enabling satisfactory pumping.

During the normal pumping operation, resistance to flow is small, clogging does not occur, and high pumping-up performance is obtained because the self-priming water separating chamber e functioning as a principal water pumping-up passage does not include therein any flow restricting part such as a cavity holder, a guide, and a baffle plate.

As mentioned earlier, the inner circumference part 1*a* of the casing 1 is formed in a circular shape concentric with the outer circumference part of the impeller 4 with a predetermined interval therebetween so that all the circumferential surfaces of the component including the wetted surfaces can be precisely finished through turning and grinding, and the manufacturing of components becomes easier. In addition, the shape of the larger volute v2 is different from that of conventional pumps, that is, the distance between the inner circumference part 1*a* of the casing 1 and the outer circumference part of the impeller 4 is constant and sufficient, whereby the pump is quiet in operation, radial load at the bearing part 8 is drastically reduced, and thus the bearing life is prolonged.

CIP (Cleaning In Place) of this pump can be easily performed, and performed in every corner, because the casing 1 and the self-priming water separating chamber e form flow passages without any partition, bottleneck or concavo-convex part at any place thereof. More specifically, internal cleaning of the casing 1 where the impeller 4 is contained can simply be performed by pouring cleaning fluid from the inlet passage a and discharging it from the discharge passage h and the drain 12 while the pump is in operation. Internal cleaning of the casing 1 where the shaft sealing part 7 is contained can be performed by pouring the cleaning fluid from the cleaning fluid inlet 9 and discharging it from the discharge passage h and the drain 12. In this way, wet areas can be cleaned without leaving any shadows. The operation is easier if valves are installed to the cleaning fluid inlet 9 and the drain 12 respectively and are closed except during cleaning.

Also, in performing COP (Cleaning Out of Place) of this pump, cleaning wet areas without leaving any shadows is possible because the casing 1 and the self-priming water separating chamber e can be easily separated at the connecting parts d1, d2, the reduced diameter part provided in the discharge passage h of the self-priming water separating chamber e as exemplified in FIG. 1 is made attachable to and detachable from the chamber e, and, the defining members 2*a*, 2*b* defining the shapes of the smaller volute v1 and the larger volute v2 respectively in the casing 1 can also be made attachable to and detachable from the casing 1. In addition, cleaning and reassembly of wet areas of the casing 1 where the shaft sealing part 7 is contained is easy because the impeller 4 can be easily pulled out from the rotating shaft 6.

Thus, the pump according to the present invention not only exhibits excellent self-priming performance and pumping performance, but is also excellent in a maintenance operation including disassembly, cleaning, checking and adjustment, and is capable of ensuring the high-purity quality of the liquid, meeting sanitary specifications. Also, the pump is highly convenient that, for instance, because of unitization of the self-priming water separating chamber e, the replacement of the chamber unit by the unit suitable to the quality of a liquid to be pumped is possible.

Second Embodiment

Figure 3:
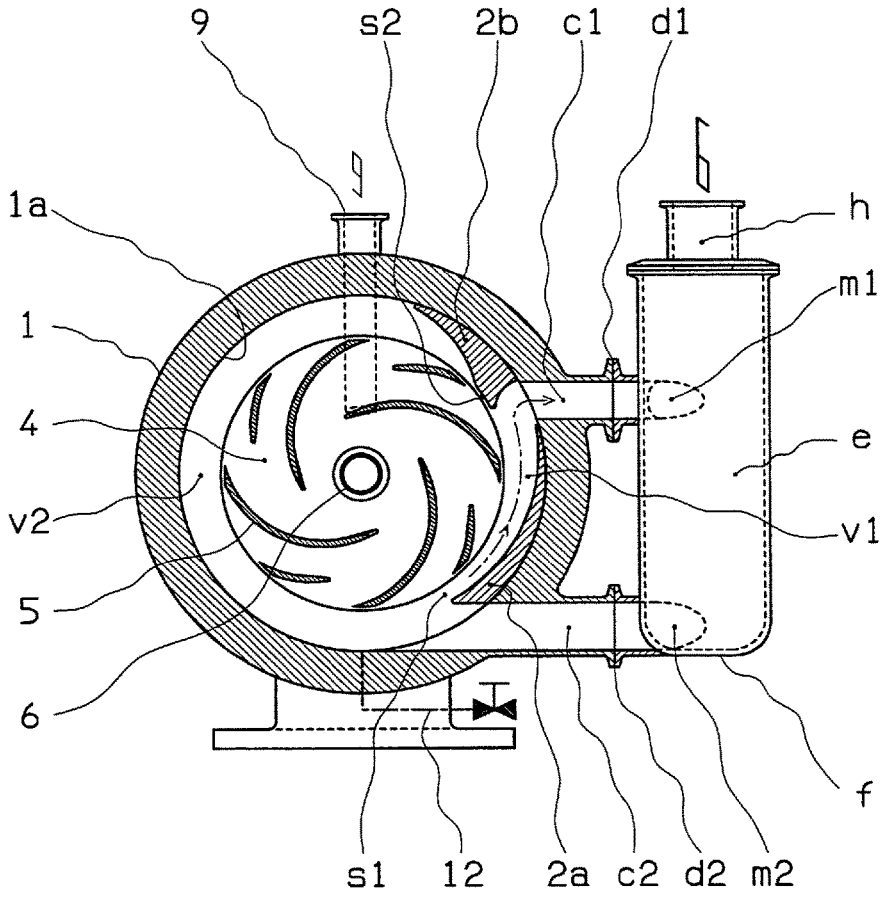
FIG. 3 is a cross-sectional view (partially a front view) of the second embodiment of the present invention.
Figure 4:
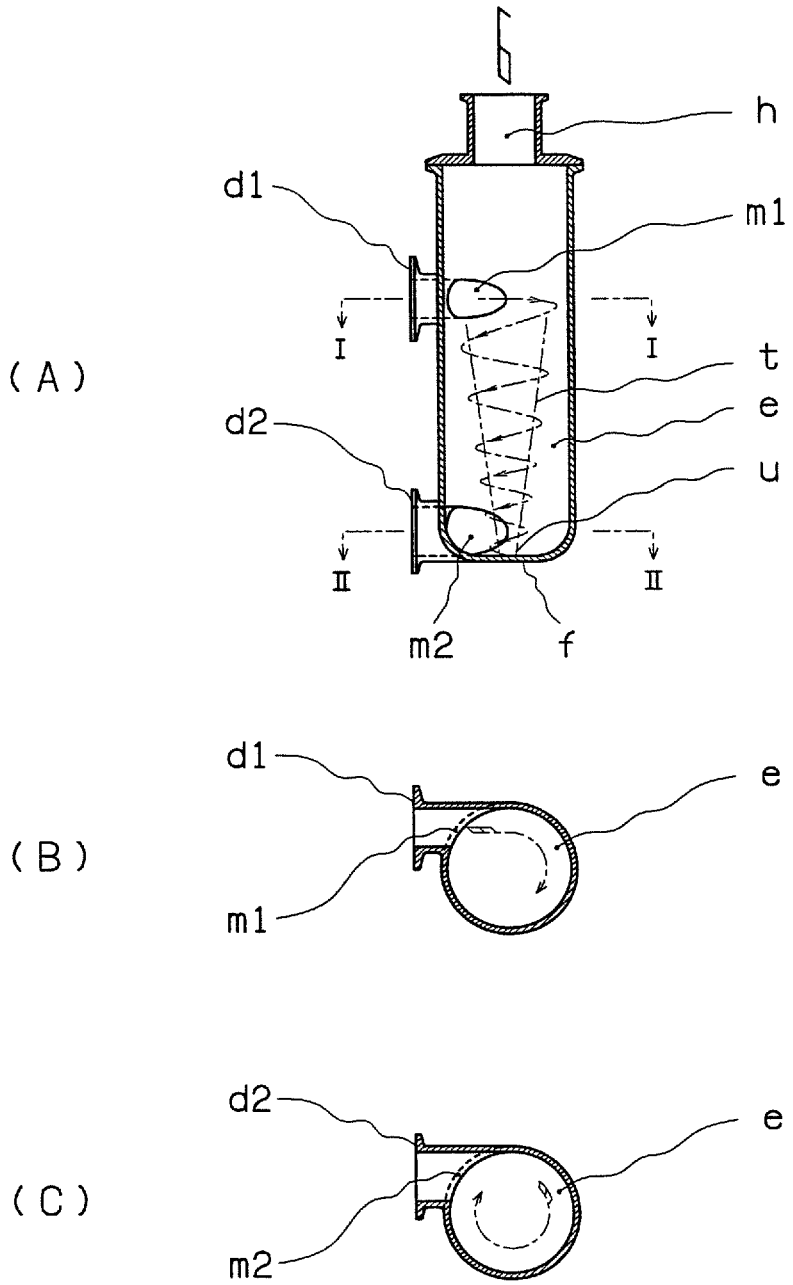
FIG. 4 (A) is a sectional view of a main part of the second embodiment of the present invention.

FIG. 3 shows a cross-sectional view of the second embodiment of the present invention, and FIG. 2 shows a longitudinal sectional view of the second embodiment (this FIG. 2 also illustrates the aforementioned first embodiment.) FIG. 4 (A) shows a sectional view of the self-priming water separating chamber e of the second embodiment, FIG. 4 (B) shows a sectional view taken along the line I-I in FIG. 4 (A), and FIG. 4 (C) shows a sectional view taken along the line II-II in FIG. 4 (A).

In this second embodiment, the opening part m1 of the spouting passage of the smaller volute v1, opened toward the self-priming water separating chamber e, is formed in a flow path that is drawn substantially tangentially into the inner wall of the chamber e so that this opening part m1 performs as the opening to generate a whirling current of the self-priming water flowing into the chamber e.

Due to this structure, the self-priming water (air-water mixture) spouted through the opening m1 flows in the whirling current along the surface of the inner wall of the upright cylindrical self-priming water separating chamber e due to its own energy, and the bubbles contained therein instantly form a tornado-shaped cavity t having a shape of an inverted circular cone in the central region of the chamber e because of centrifugal air-water separation. The air centrifugally separated from the self-priming water flows upward and is discharged through the discharge passage h. By the reduced diameter part provided in the discharge passage h in the upper part of the self-priming water separating chamber e, the rising of the water level in the chamber e caused by the whirling current of the self-priming water can be effectively suppressed and an overflow of the self-priming water to the discharge side is prevented.

Thus, the pump of the second embodiment is the pump with further improved self-priming performance than that of the first embodiment attained by adding the effect of the centrifugal air-water separation created by forcibly whirling the self-priming water.

In respect to a whirling direction of the flow path drawn into the self-priming water separating chamber e through the opening part m1, it may be clockwise, as illustrated in the figure, or counterclockwise when viewed from the above.

Meantime, in this embodiment, it is further exemplified that the opening part m2 of the passage from the larger volute v2, opened toward the self-priming water separating chamber e, is also formed in a flow path that is drawn substantially tangentially into the inner wall of the chamber e.

In FIG. 3 and FIG. 4, a whirling direction of the opening part m2 is set clockwise when viewed from the above so that this direction coincides with the whirling direction of the opening part m1 of the spouting passage of the smaller volute v1. However, the whirling direction of the opening part m2 can be set counterclockwise or can be set straight toward the center of the self-priming water separating chamber e without any whirling, and the respective choice of such direction has respective characteristics.

For example, as illustrated in FIG. 3 and FIG. 4, if the same whirling direction is arranged for the opening parts m1, m2 whose passages extend from the smaller volute v1 and the larger volute v2 respectively, those two opening parts m1, m2 are aligned on a perpendicular line enabling an easy machining of the connecting parts d1, d2, and an easy alignment of those parts. Further, at the time of normal pumping operation, the whirling current of the water from the larger volute v2 flowing into the self-priming water separating chamber e and the whirling current of the water from the smaller volute v1 flowing into the chamber e, given the same whirling direction, join in such a way as to intensify the rotation of the self-priming water in the chamber e. Generation of such a strong whirling current, on the one hand, becomes a disadvantage if an adverse effect of the whirling current to influence the following process connected to the pump has to be eliminated, but on the other hand, such a strong whirling current becomes an advantage particularly when thorough cleaning of the chamber e is required, thereby greatly facilitating CIP (Cleaning In Place).

Conversely, if the opposite whirling directions are arranged for the opening parts m1, m2 whose passages extend from the smaller volute v1 and the larger volute v2 respectively, those two opening parts m1, m2 are not aligned on a perpendicular line resulting in a rather complicated machining of the connecting parts d1, d2, and a rather complicated alignment of those parts. However, at the time of normal pumping operation, the whirling current of the water from the larger volute v2 flowing into the self-priming water separating chamber e and the whirling current of the water from the smaller volute v1 flowing into the chamber e, given the opposite whirling directions, join in such a way as to offset or alleviate the rotation of the self-priming water in the chamber e, and the water flows out to the discharge passage h in a substantially straight current, whereby this arrangement brings an advantage that an adverse effect of the whirling current does not influence the following process connected to the pump.

Furthermore, there may be other arrangement such that the whirling direction of the opening part m1 of the passage from the smaller volute v1 is set either clockwise or counterclockwise when viewed from the above, and the outflow direction of the opening part m2 of the passage from the larger volute v2 is set straight toward the center of the self-priming water separating chamber e without any whirling. (A concrete example of this arrangement will be described later in the third embodiment of the present invention.)

The rest of the constitution and functions are the same as those of the first embodiment.

Third Embodiment

Figure 5:
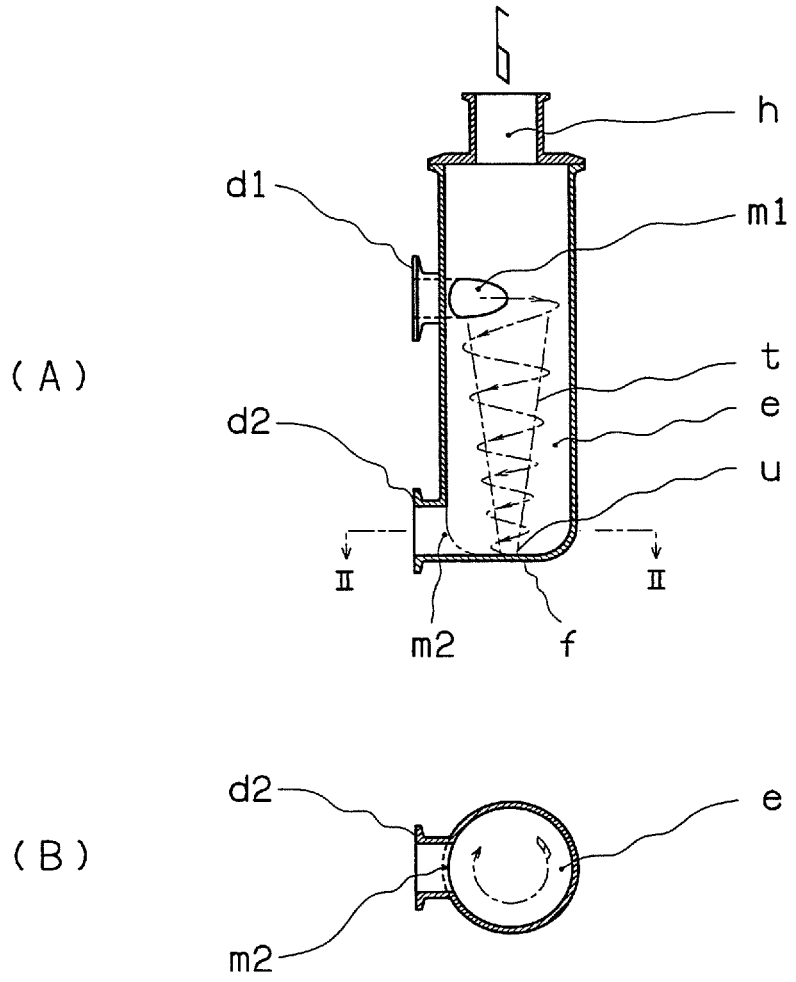
FIG. 5 (A) is a sectional view of a main part of the third embodiment of the present invention.

FIG. 5 (A) shows a sectional view of the self-priming water separating chamber e of the third embodiment of the present invention, and FIG. 5 (B) shows a sectional view taken along the line II-II in FIG. 5 (A).

In this third embodiment, there is an arrangement that the whirling direction of the opening part m1 of the passage from the smaller volute v1, opened toward the self-priming water separating chamber e, is set either clockwise or counterclockwise when viewed from the above, and the outflow direction of the opening part m2 of the passage from the larger volute v2 is set straight toward the center of the self-priming water separating chamber e without any whirling.

The rest of the constitution and functions are the same as those of the second embodiment.

Fourth Embodiment

Figure 6:
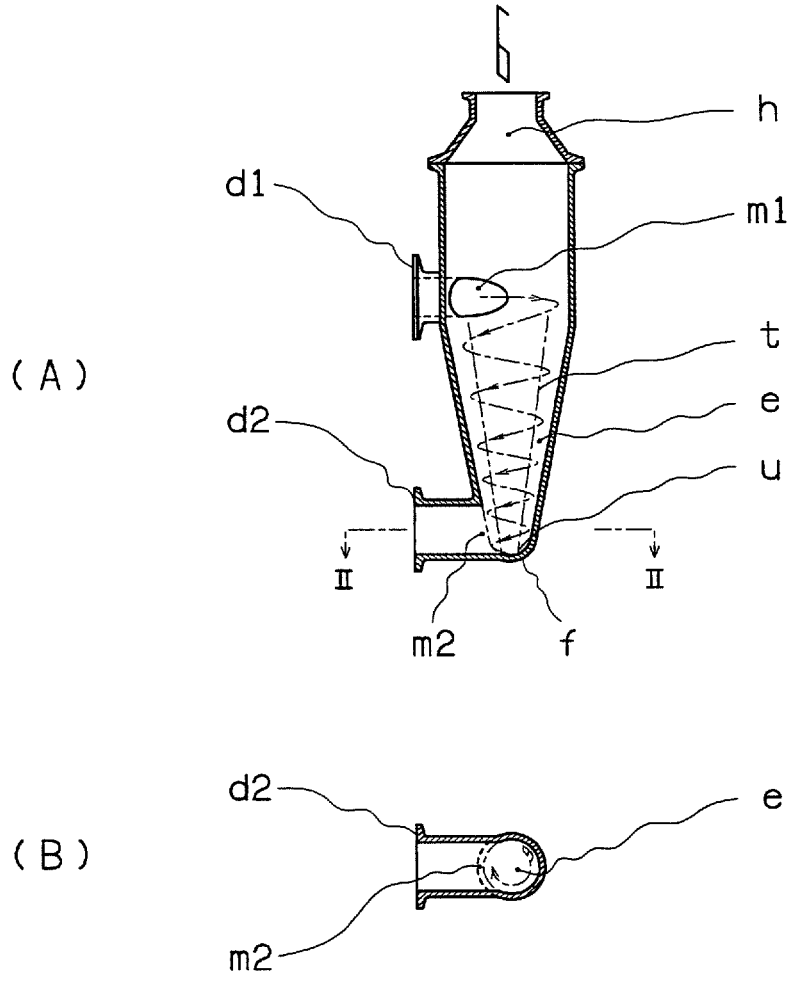
FIG. 6 (A) is a sectional view of a main part of the fourth embodiment of the present invention.

FIG. 6 (A) shows a sectional view of the self-priming water separating chamber e of the fourth embodiment of the present invention, and FIG. 6 (B) shows a sectional view taken along the line II-II in FIG. 6 (A).

In this fourth embodiment, the self-priming water separating chamber e is formed such that its inner wall is not constant in the dimension of a diameter with respect to the longitudinal direction. The self-priming water separating chamber e whose lower part is shaped like a straight cone opened upward is illustrated as an example, but the shape of that part is not limited to this, and may be any of various curved shapes including trumpet-shape, inverted-bell-shape, etc. Whichever shape is chosen, there is an advantage in having a gradually reduced diameter downward, because, as the whirling current of the self-priming water flows downward, its rotation speed increases and the centrifugal separation becomes more powerful, and the more definite tornado-shaped cavity t is formed. Furthermore, it is illustrated as an example that the reduced diameter part in the discharge passage h may be shaped like a cone.

The rest of the constitution and functions are the same as those of the second embodiment and the third embodiment.

Fifth Embodiment

Figure 7:
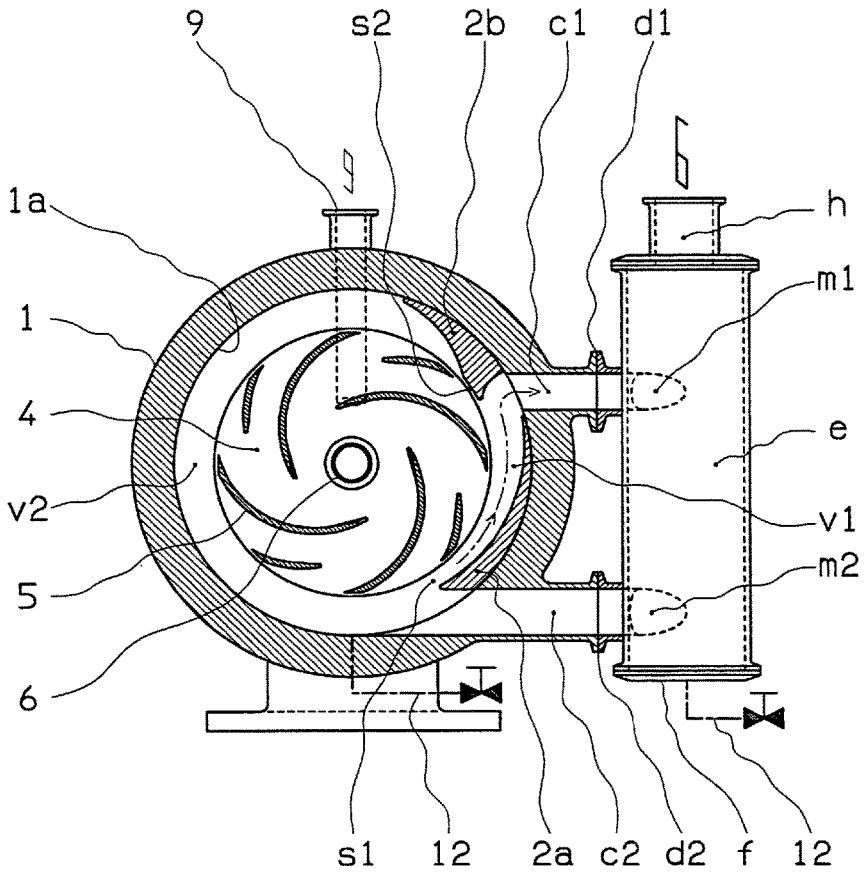
FIG. 7 is a cross-sectional view (partially a front view) of the fifth embodiment of the present invention.
Figure 8:
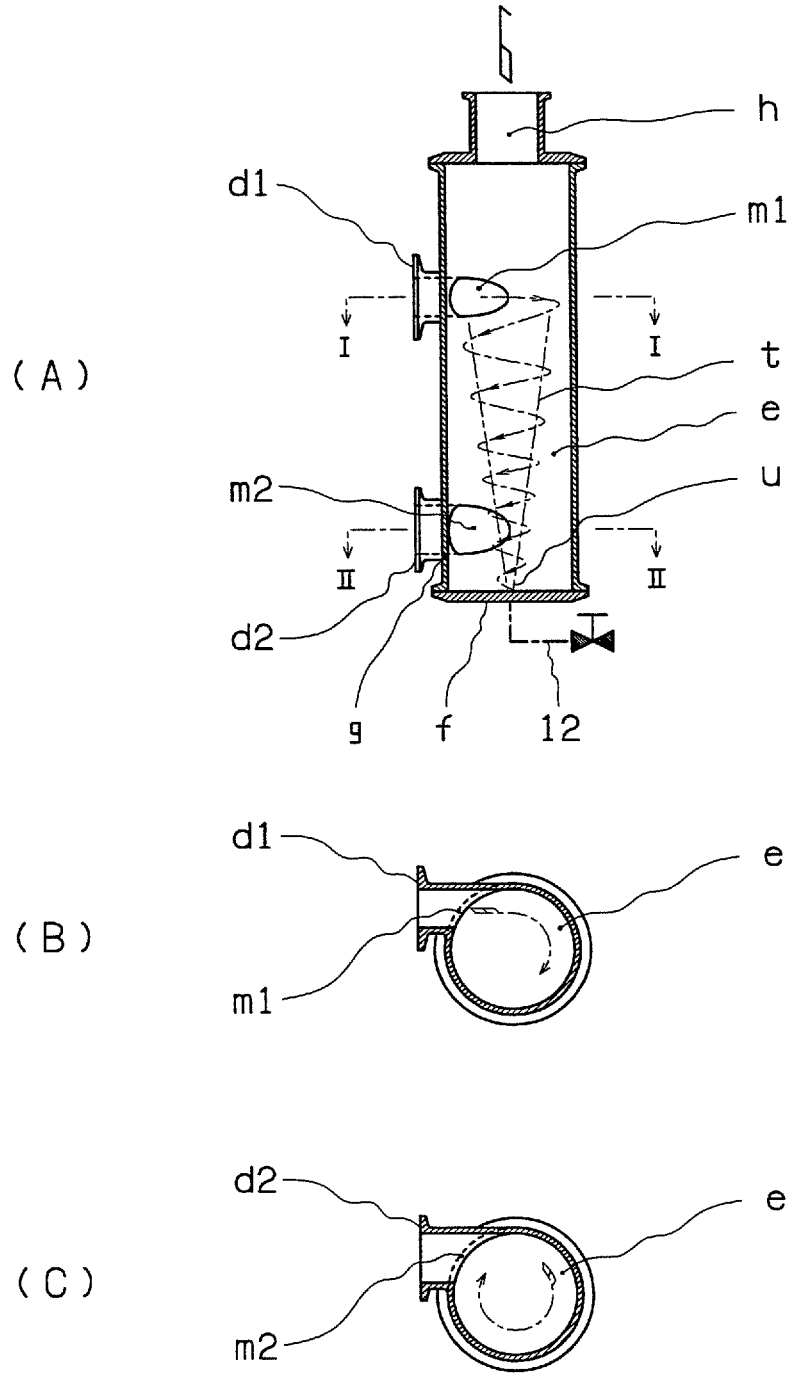
FIG. 8 (A) is a sectional view of a main part of the fifth embodiment of the present invention.

FIG. 7 shows a cross-sectional view of the fifth embodiment of the present invention. FIG. 8 (A) shows a sectional view of the self-priming water separating chamber e of the fifth embodiment, FIG. 8 (B) shows a sectional view taken along the line I-I in FIG. 8 (A), and FIG. 8 (C) shows a sectional view taken along the line II-II in FIG. 8 (A).

This fifth embodiment illustrates an example of additional means to accurately prevent a tail bottom u of the tornado-shaped cavity t caused by the rotation of the self-priming water from extending and being sucked into the larger volute v2 in such a situation that the operating condition fluctuates intensely. And its structure is such that the self-priming water separating chamber e is formed into a bottomed cylindrical shape, and the vicinity of the center of the bottom f of the chamber e is positioned lower than the lower end g of the cross section of the opening part m2 of the passage from the larger volute v2 opened toward the chamber e.

The pump of the present invention is basically characterized by a common passage that serves as both a self-priming water circulating passage during self-priming operation and a discharge passage during normal pumping operation, as mentioned earlier, and based on this, the pump is configured in such a way that the self-priming water separating chamber e functioning as a diffuser during normal pumping operation does not include therein any flow restricting part, so as to minimize a resistance to flow and achieve high pumping-up performance as well as self-priming performance, and so as to additionally achieve an excellent cleanability due to non-existence of such a flow restricting part. When such a configuration is adopted, it is desirable to provide a new means, not relying on the flow restricting means such as a cavity holder or a guide, to prevent the tail bottom of the tornado-shaped cavity generated in the self-priming water separating chamber e from being sucked into the larger volute v2 and hampering the self-priming operation.

In this fifth embodiment, in order to prevent the tail bottom u of the tornado-shaped cavity t caused by the rotation of the self-priming water from extending and being sucked into the larger volute v2, the self-priming water separating chamber e is formed such that its inner wall does not have anything to damp the whirling momentum of the self-priming water (a bottleneck, a cavity holder, a guide, a baffle plate, a protrusion, or other concavo-convex parts etc.), thereby giving priority to keeping the maximum rotation speed of the whirling current of the self-priming water, and thereby making strong centrifugal separation act thoroughly from the top to the tail bottom u of the tornado-shaped cavity t to realize the definite tornado-shaped cavity t and the clear and sharp tail bottom u. Besides, a step-like level difference, which is not easy for the tail bottom u to cross over, is provided between the bottom f of the chamber e where the tail bottom u touches down and the lower end g of the cross section of the opening part m2 of the passage toward the larger volute v2, the latter being higher than the former, so that this level difference (g-f) works to confine the tornado-shaped cavity t to the bottom f of the chamber e. And, by such a structure that it does not obstruct a rotation of a tornado but it obstructs a crawling movement of its tail bottom, the pump of this embodiment prevents the tornado-shaped cavity t from extending and being sucked into the larger volute v2.

During the self-priming operation, the tail bottom u of the tornado-shaped cavity t caused by the rotation of the self-priming water is stably located on a flat area in the vicinity of the center of the bottom f of the self-priming water separating chamber e, and continues to stay there rather than crawling toward the larger volute v2 crossing over the step-like level difference (g-f) provided between the self-priming water separating chamber e and the passage toward the larger volute v2. Therefore, the pump continues the high level self-priming operation stably, and, when the self-priming operation is completed and the normal pumping operation is started, it exerts high pumping-up performance while resistance to flow is small because the flow passage does not include therein any flow restricting part such as a cavity holder and a guide, etc.

Meantime, as the bottom f of the self-priming water separating chamber e is positioned lower than the lower end g of the cross section of the opening part m2 of the passage from the larger volute v2, it is desirable to provide a drain 12 to the bottom f, as exemplified in the figure, so as to prevent a liquid to be pumped from stagnating at the bottom f.

And, it is also exemplified in the figure that the bottom f of the self-priming water separating chamber e can be separated from the main part of the chamber e to become a lid-like member attachable to and detachable from that main part. By this arrangement, the machining and grinding work on the parts such as the passage c2, the opening part m2, and the chamber bottom f, which tend to be left as shadows in conventional methods, can now be thoroughly performed in a state that the lid-like member is opened, and disassembled cleaning can also be done easily.

The rest of the constitution and functions are the same as those of the second embodiment.

Sixth Embodiment

Figure 9:
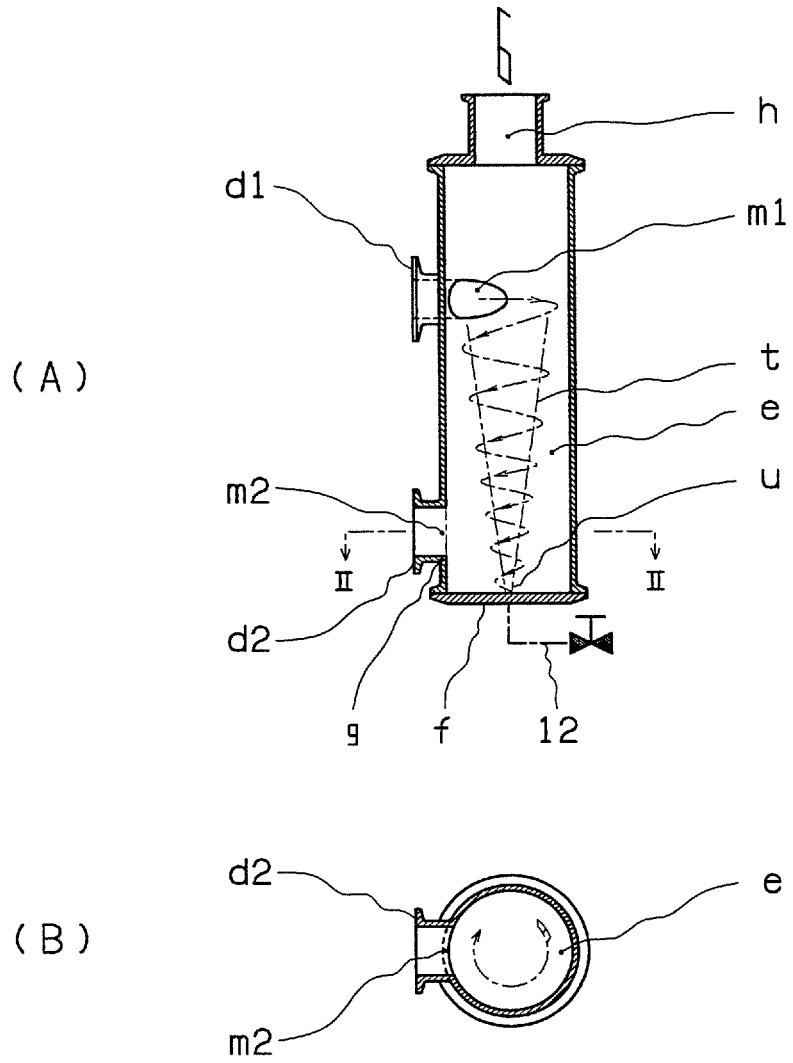
FIG. 9 (A) is a sectional view of a main part of the sixth embodiment of the present invention.

FIG. 9 (A) shows a sectional view of the self-priming water separating chamber e of the sixth embodiment of the present invention, and FIG. 9 (B) shows a sectional view taken along the line II-II in FIG. 9 (A).

In this sixth embodiment, there is an arrangement that the whirling direction of the opening part m1 of the passage from the smaller volute v1, opened toward the self-priming water separating chamber e, is set either clockwise or counterclockwise when viewed from the above, and the outflow direction of the opening part m2 of the passage from the larger volute v2 is set straight toward the center of the self-priming water separating chamber e without any whirling.

The rest of the constitution and functions are the same as those of the fifth embodiment.

Seventh Embodiment

Figure 10:
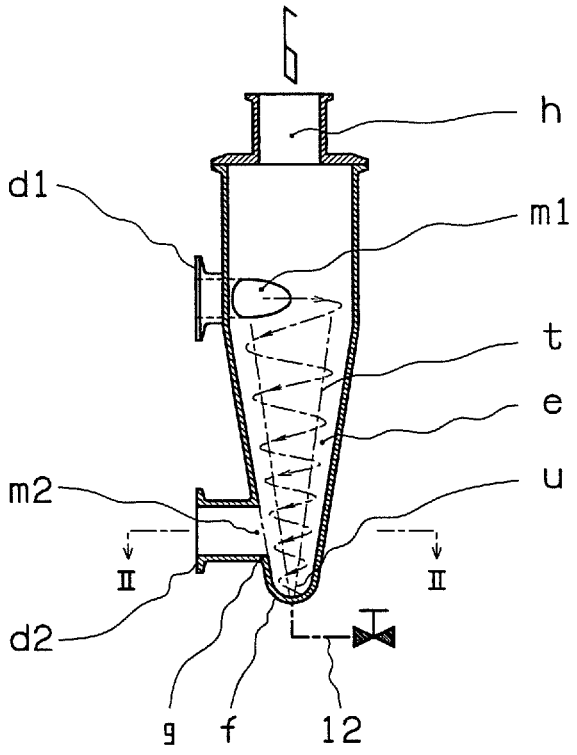
FIG. 10 (A) is a sectional view of a main part of the seventh embodiment of the present invention.
Figure 10:
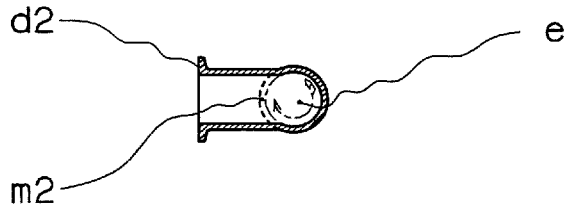

FIG. 10 (A) shows a sectional view of the self-priming water separating chamber e of the seventh embodiment of the present invention, and FIG. 10 (B) shows a sectional view taken along the line II-II in FIG. 10 (A).

In this seventh embodiment, the self-priming water separating chamber e is formed such that its inner wall is not constant in the dimension of a diameter with respect to the longitudinal direction. The self-priming water separating chamber e whose lower part is shaped like a straight cone opened upward is illustrated as an example, but the shape of that part is not limited to this, and may be any of various curved shapes including trumpet-shape, inverted-bell-shape, etc. Whichever shape is chosen, there is an advantage in having a gradually reduced diameter downward, because, as the whirling current of the self-priming water flows downward, its rotation speed increases and the centrifugal separation becomes more powerful, and the more definite tornado-shaped cavity t is formed.

The rest of the constitution and functions are the same as those of the fifth embodiment and the sixth embodiment.

Eighth Embodiment

Figure 11:
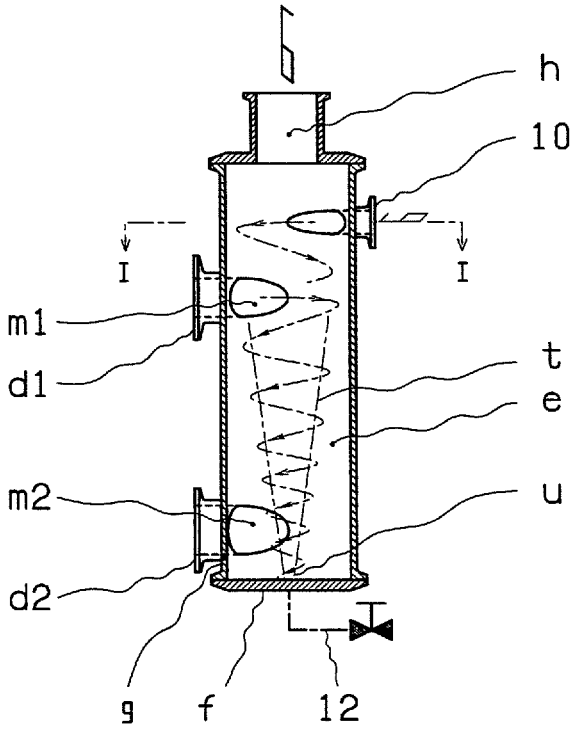
FIG. 11 (A) is a sectional view of a main part of the eighth embodiment of the present invention.
Figure 11:
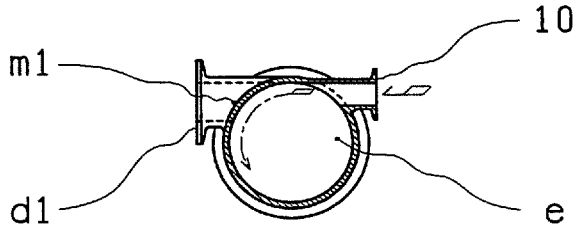

FIG. 11 (A) shows a sectional view of the self-priming water separating chamber e of the eighth embodiment of the present invention, and FIG. 11 (B) shows a sectional view taken along the line I-I in FIG. 11 (A).

In this eighth embodiment, a cleaning fluid inlet 10 is provided on the upper part of the self-priming water separating chamber e.

The inflow angle of the cleaning fluid inlet 10 toward the self-priming water separating chamber e may be suitably selected, but it is preferable that the flow path of the cleaning fluid inlet 10 is arranged to be winding tangentially into the chamber e so that the cleaning fluid spreads into every corner while being whirled in the chamber e, enabling to improve the cleaning effect.

This embodiment further shows that it is more preferable that the cleaning fluid inlet 10 is located at a position higher than that of the opening part m1 of the spouting passage of the smaller volute v1, and a direction of the cleaning fluid injection through the cleaning fluid inlet 10 into the self-priming water separating chamber e is arranged to be opposite to the rotating direction of the whirling current of the self-priming water generated in the chamber e. In this case, the cleaning fluid injected from the cleaning fluid inlet 10 gradually falls down while whirling and cleaning the entire inside of the self-priming water separating chamber e evenly, and when it reaches the opening part m1 of the spouting passage c1 of the smaller volute v1, it proceeds straight into the passage c1, cleaning that passage c1 followed by the smaller volute v1 in a flow sequence opposite to that of the self-priming and the normal pumping operations, whereby the further improved cleaning effect can be obtained.

This embodiment also illustrates that the step-like level difference (g-f) provided between the lower end g of the cross section of the opening part m2 and the bottom f of the self-priming water separating chamber e in the previously described fifth embodiment, can now be reduced as exemplified in the figure. This level difference (g-f) can be further reduced depending on the operating condition of the pump, and if the level difference is set to zero, the constitution of that part becomes substantially the same as that of the second embodiment.

The rest of the constitution and functions are the same as those of the fifth embodiment.

Ninth Embodiment

Figure 12:
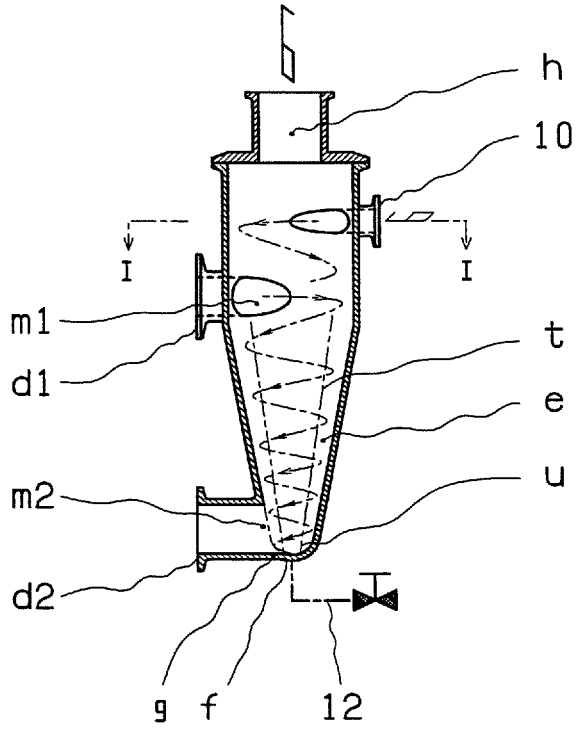
FIG. 12 (A) is a sectional view of a main part of the ninth embodiment of the present invention.
Figure 12:
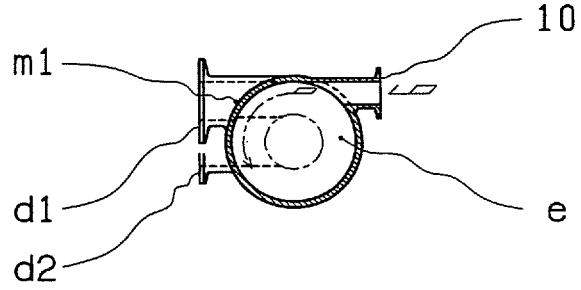

FIG. 12 (A) shows a sectional view of the self-priming water separating chamber e of the ninth embodiment of the present invention, and FIG. 12 (B) shows a sectional view taken along the line I-I in FIG. 12 (A).

In this ninth embodiment, the self-priming water separating chamber e is formed such that its inner wall is not constant in the dimension of a diameter with respect to the longitudinal direction. The self-priming water separating chamber e whose lower part is shaped like a straight cone opened upward is illustrated as an example, but the shape of that part is not limited to this, and may be any of various curved shapes.

The rest of the constitution and functions are the same as those of the seventh embodiment and the eighth embodiment.

Tenth Embodiment

Figure 13:
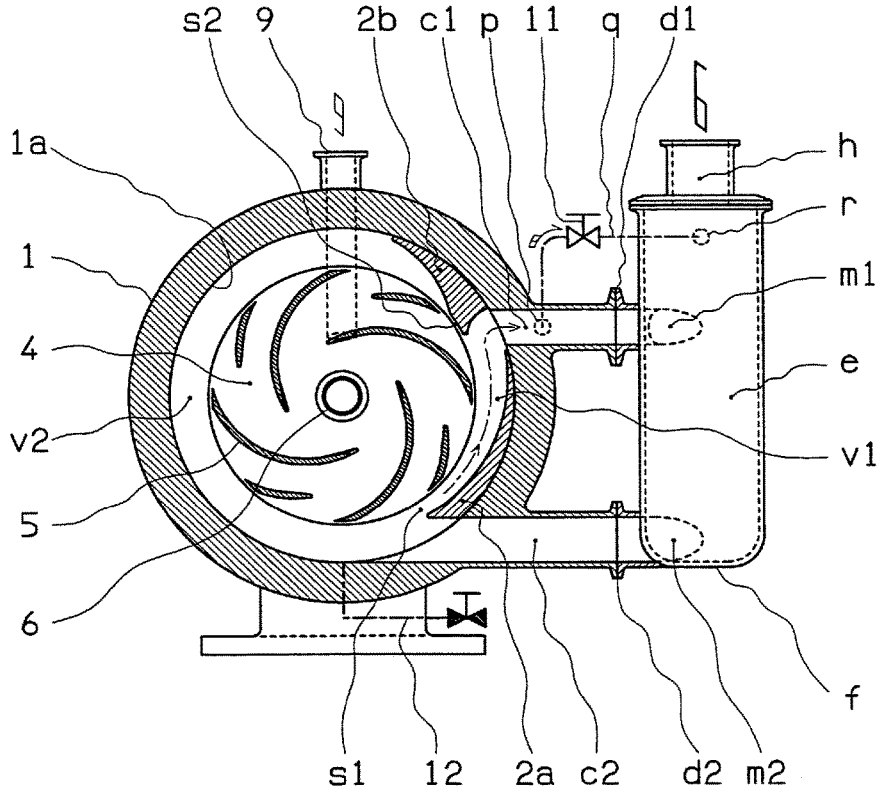
FIG. 13 is a cross-sectional view (partially a front view) of the tenth embodiment of the present invention.
Figure 14:
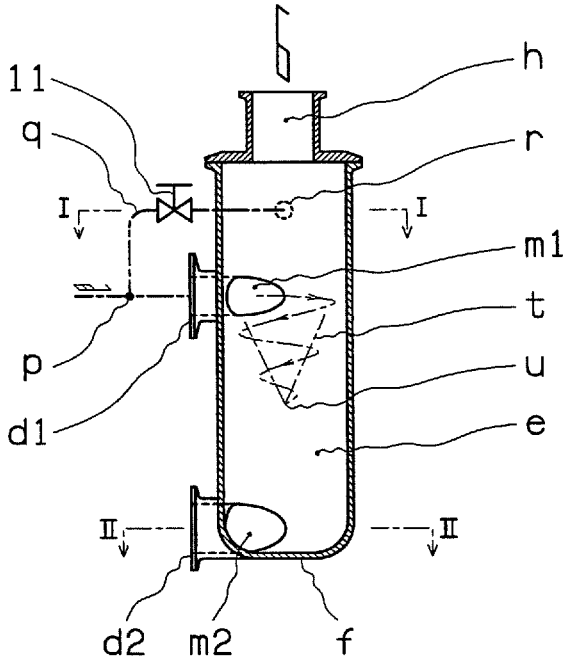
FIG. 14 (A) is a sectional view of a main part of the tenth embodiment of the present invention.
Figure 14:
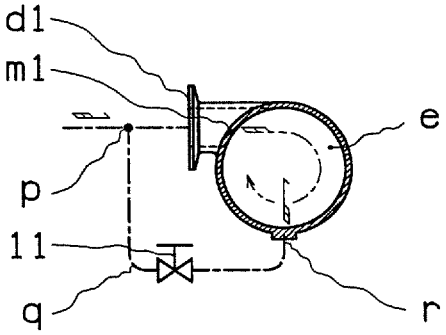
Figure 14:
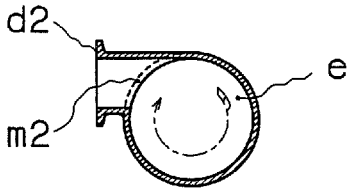

FIG. 13 shows a cross-sectional view of the tenth embodiment of the present invention. FIG. 14 (A) shows a sectional view of the self-priming water separating chamber e of the tenth embodiment, FIG. 14 (B) shows a sectional view taken along the line I-I in FIG. 14 (A), and FIG. 14 (C) shows a sectional view taken along the line II-II in FIG. 14 (A).

This tenth embodiment illustrates a new example of additional means to prevent the tail bottom u of the tornado-shaped cavity t caused by the rotation of the self-priming water from extending and being sucked into the larger volute v2, which is a new approach different from the previously described fifth to ninth embodiments. And its structure is such that the opening part m1 of the spouting passage of the smaller volute v1, opened toward the self-priming water separating chamber e, is formed in the flow path that is drawn substantially tangentially into the chamber e so that the self-priming water flowing from the smaller volute v1 into the chamber e generates the whirling current for centrifugal air-water separation, whereas the self-priming water flowing from the smaller volute v1 is partially branched at a branch point p before reaching the opening part m1 of the spouting passage c1, and this branched flow flows out into the self-priming water separating chamber e through an opening part r of the branch flow passage separately provided at a height position nearly equal to or higher than that of the opening part m1 of the spouting passage of the smaller volute v1.

In this embodiment, the outflow direction of the branched flow flowing out into the self-priming water separating chamber e through the opening part r of the branch flow passage is set straight toward the center of the self-priming water separating chamber e without any whirling.

A flow rate adjusting means 11 is inserted in the branch flow passage q, enabling an adjustment of a flow rate of the branch flow of the self-priming water. A common type valve can be applied to the flow rate adjusting means 11 as illustrated.

Because of such constitution of this tenth embodiment, when the self-priming water flowing from the smaller volute v1 flows out into the self-priming water separating chamber e, a major portion of it flows out through the opening part m1 of the spouting passage generating a whirling current in the chamber e, whereas the branch portion of it flows out through the opening part r of the branch flow passage into the chamber e in a straight manner without contributing to the rotation of the whirling current, thus, not all the spouting energy of the self-priming water is converted into a rotational momentum of the whirling current, and the whirling current is moderated to that extent. By suitably adjusting the flow rate of the branch flow using the flow rate adjusting means 11, the degree of moderation of the whirling current can optionally be adjusted, namely, the strength of the whirling current can be controlled.

Thus, in this tenth embodiment, by controlling the strength of the whirling current so that the height position of the tail bottom u of the tornado-shaped cavity t is kept nearly in the middle of the self-priming water separating chamber e and is kept not lower than that in a natural state, the tail bottom u of the tornado-shaped cavity t is prevented from extending and being sucked into the larger volute v2.

Since this branch flow flows out into the self-priming water separating chamber e through the opening part r of the branch flow passage at a height position nearly equal to or higher than that of the opening part m1 of the spouting passage in a straight manner without generating any whirling current, this branch flow does not undergo any process of "centrifugal" air-water separation at that moment, however, this flow undergoes a process of "spontaneous" air-water separation instead, and after this flow falls down to join the whirling current of the self-priming water spouted through the opening part m1 of the spouting passage, it is then subjected to the centrifugal air-water separation altogether. Thus, there is no possibility of deterioration in the air-water separation performance through the above branching of the flow.

As for the flow rate adjusting means 11 in the branch flow passage q, a fixed type orifice may be applied. And the selection of suitable size of the fixed type orifice can be made by initially applying a valve to the flow rate adjusting means 11 to determine the optimum flow rate and then replacing it by the suitably-sized orifice, or can be made by providing orifices of various flow rates from which the suitable one is selected on a case by case basis.

Alternatively, if the optimum flow rate in the branch flow passage q is already determined or is determined by initially applying a valve to the flow rate adjusting means 11, the branch flow passage q having the sectional area to attain the optimum flow rate by itself may be selected in place of any flow rate adjusting means 11.

In respect to the whirling direction of the flow path drawn into the self-priming water separating chamber e through the opening part m1 of the spouting passage of the smaller volute v1, it may be clockwise, as illustrated in the figure, or counterclockwise when viewed from the above.

And, in respect to the opening part m2 of the passage from the larger volute v2, in the same manner as in the second embodiment, the whirling direction of the opening part m2 may be set in the same direction as the whirling direction of the opening part m1 of the spouting passage of the smaller volute v1 as illustrated in the figure, or may be set in the direction opposite to that of the opening part m1, or may be set straight toward the center of the self-priming water separating chamber e without any whirling.

The rest of the constitution and functions are the same as those of the second embodiment.

Eleventh Embodiment

Figure 15:
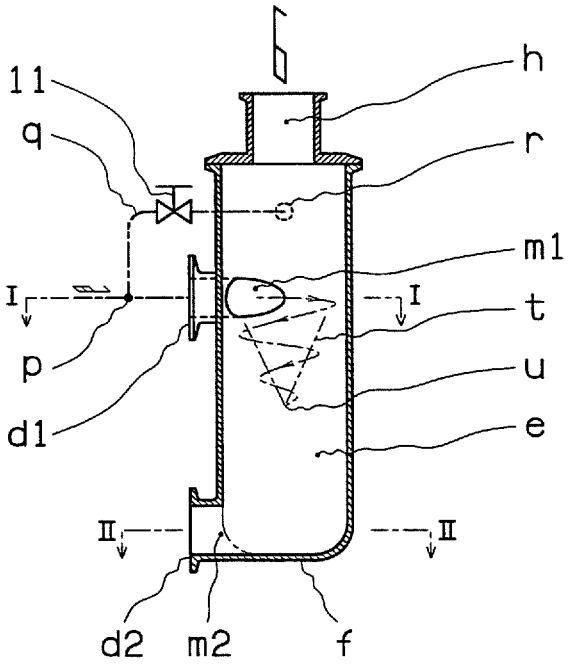
FIG. 15 (A) is a sectional view of a main part of the eleventh embodiment of the present invention.
Figure 15:
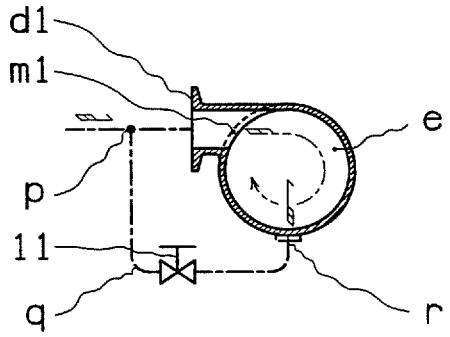
Figure 15:
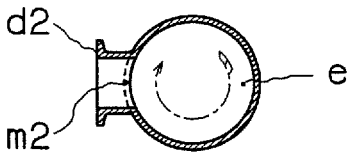

FIG. 15 (A) shows a sectional view of the self-priming water separating chamber e of the eleventh embodiment of the present invention, FIG. 15 (B) shows a sectional view taken along the line I-I in FIG. 15 (A), and FIG. 15 (C) shows a sectional view taken along the line II-II in FIG. 15 (A).

In this eleventh embodiment, there is an arrangement that the whirling direction of the opening part m1 of the passage from the smaller volute v1, opened toward the self-priming water separating chamber e, is set either clockwise or counterclockwise when viewed from the above, and the outflow direction of the opening part m2 of the passage from the larger volute v2 is set straight toward the center of the self-priming water separating chamber e without any whirling.

The rest of the constitution and functions are the same as those of the tenth embodiment.

Twelfth Embodiment

Figure 16:
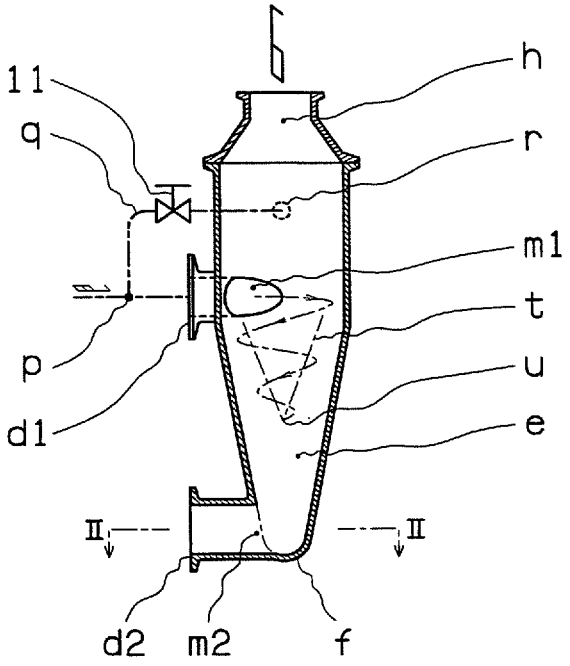
FIG. 16 (A) is a sectional view of a main part of the twelfth embodiment of the present invention.
Figure 16:
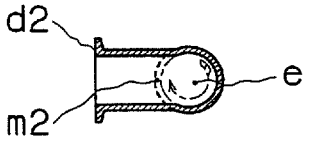

FIG. 16 (A) shows a sectional view of the self-priming water separating chamber e of the twelfth embodiment of the present invention, and FIG. 16 (B) shows a sectional view taken along the line II-II in FIG. 16 (A).

In this twelfth embodiment, the self-priming water separating chamber e is formed such that its inner wall is not constant in the dimension of a diameter with respect to the longitudinal direction. The self-priming water separating chamber e whose lower part is shaped like a straight cone opened upward is illustrated as an example, but the shape of that part is not limited to this, and may be any of various curved shapes.

Furthermore, it is illustrated as an example that the reduced diameter part in the discharge passage h may be shaped like a cone.

The rest of the constitution and functions are the same as those of the tenth embodiment and the eleventh embodiment.

Thirteenth Embodiment

Figure 17:
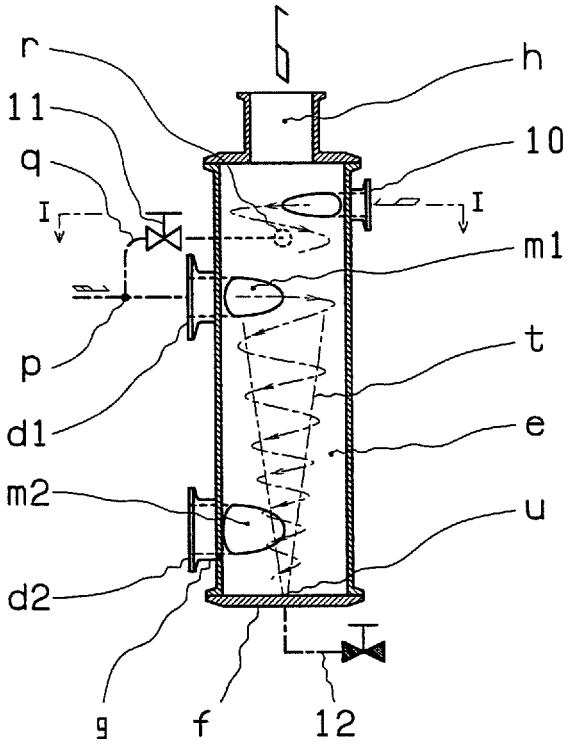
FIG. 17 (A) is a sectional view of a main part of the thirteenth embodiment of the present invention.
Figure 17:
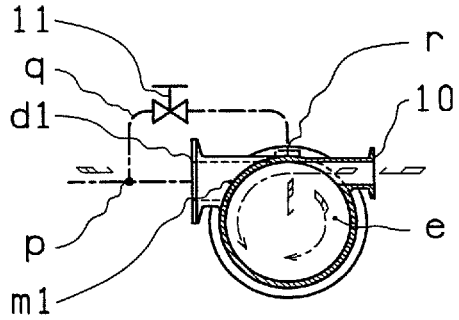

FIG. 17 (A) shows a sectional view of the self-priming water separating chamber e of the thirteenth embodiment of the present invention, and FIG. 17 (B) shows a sectional view taken along the line I-I in FIG. 17 (A).

This thirteenth embodiment illustrates an example of additional means to prevent the tail bottom u of the tornado-shaped cavity t caused by the rotation of the self-priming water from extending and being sucked into the larger volute v2 in such a situation that the operating condition fluctuates intensely which may occur in the previously described tenth to twelfth embodiments. And its structure is such that the self-priming water separating chamber e is formed into a bottomed cylindrical shape, the vicinity of the center of the bottom f of the chamber e being positioned lower than the lower end g of the cross section of the opening part m2 of the passage from the larger volute v2 opened toward the chamber e. Namely, a step-like level difference (g-f), which is not easy for the tail bottom u to cross over, is provided between the bottom f of the chamber e where the tail bottom u, if extended, touches down and the opening part m2 of the passage toward the larger volute v2 so that this level difference (g-f) works to confine the tornado-shaped cavity t to the bottom f of the chamber e. Thus, even if the tail bottom u of the tornado-shaped cavity t extends during the self-priming operation, it continues to stay within the chamber e rather than crawling toward the larger volute v2 and crossing over the step-like level difference (g-f), so that the pump continues the high level self-priming operation stably.

The level difference (g-f) can be reduced depending on the operating condition of the pump, and if the level difference is set to zero, the constitution of that part becomes substantially the same as that of the tenth embodiment.

This thirteenth embodiment also illustrates that the cleaning fluid inlet 10 may be provided on the upper part of the self-priming water separating chamber e. The inflow angle and the shape of the flow path of the cleaning fluid inlet 10 toward the self-priming water separating chamber e may be suitably selected, but it is preferable that the flow path of the cleaning fluid inlet 10 is arranged to be winding tangentially into the chamber e so that the cleaning fluid spreads into every corner while being whirled in the chamber e, enabling to improve the cleaning effect.

This embodiment further shows that it is more preferable that the cleaning fluid inlet 10 is located at a position higher than that of the opening part m1 of the spouting passage of the smaller volute v1, and a direction of the cleaning fluid injection through the cleaning fluid inlet 10 into the self-priming water separating chamber e is arranged to be opposite to the rotating direction of the whirling current of the self-priming water generated in the chamber e. In this case, the cleaning fluid injected from the cleaning fluid inlet 10 gradually falls down while whirling and cleaning the entire inside of the self-priming water separating chamber e evenly, and when it reaches the opening part m1 of the spouting passage c1 of the smaller volute v1, it proceeds straight into the passage c1, cleaning that passage c1 followed by the smaller volute v1 in a flow sequence opposite to that of the self-priming and the normal pumping operations, whereby the further improved cleaning effect can be obtained.

The rest of the constitution and functions are the same as those of the eighth embodiment and the tenth embodiment.

Fourteenth Embodiment

Figure 18:
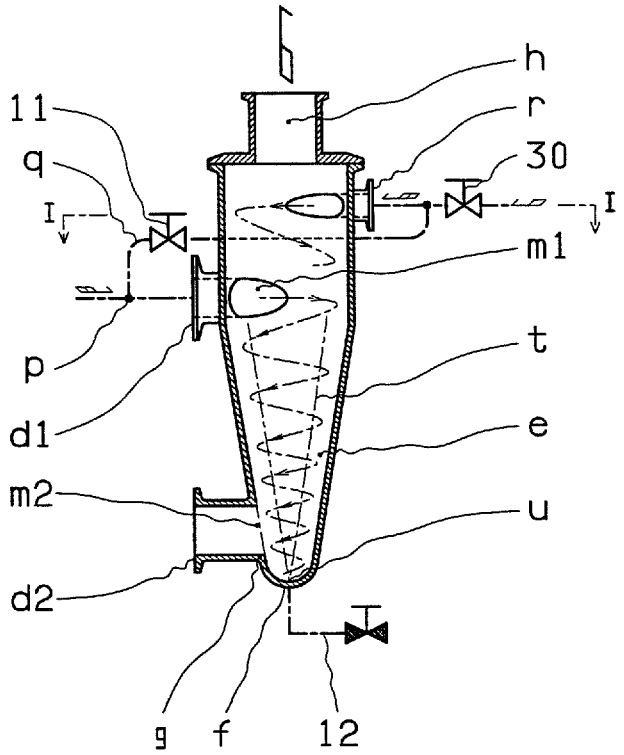
FIG. 18 (A) is a sectional view of a main part of the fourteenth embodiment of the present invention.
Figure 18:
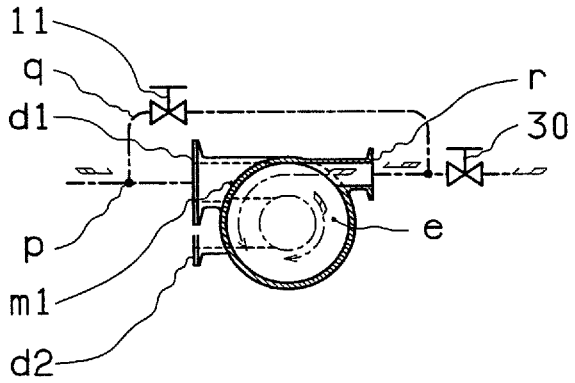

FIG. 18 (A) shows a sectional view of the self-priming water separating chamber e of the fourteenth embodiment of the present invention, and FIG. 18 (B) shows a sectional view taken along the line I-I in FIG. 18 (A).

In this fourteenth embodiment, the self-priming water separating chamber e is formed such that its inner wall is not constant in the dimension of a diameter with respect to the longitudinal direction. The self-priming water separating chamber e whose lower part is shaped like a straight cone opened upward is illustrated as an example, but the shape of that part is not limited to this, and may be any of various curved shapes.

This fourteenth embodiment also illustrates that the cleaning fluid inlet provided for cleaning the inside of the self-priming water separating chamber e (such as the cleaning fluid inlet 10 in the previously described thirteenth embodiment) may be formed in such a way that it also serves as the opening part r of the branch flow passage.

If, as exemplified in this embodiment, the outflow direction of the opening part r of the branch flow passage is set so that the outflow of the branch flow suppresses the whirling current of the self-priming water, it means that this opening part r can also serve as the cleaning fluid inlet 10 described in the thirteenth embodiment conveniently.

In the previously described tenth to thirteenth embodiments, the branch flow of the self-priming water flows out through the opening part r of the branch flow passage into the chamber e in a straight manner without contributing to the rotation of the whirling current, moderating the whirling current to that extent. However, if it becomes necessary to further moderate the whirling current, an effective way is to arrange the branch flow of the self-priming water to flow out into the chamber e in the opposite direction to the rotating direction of the whirling current of the self-priming water, as exemplified in this embodiment.

When the opening part r of the branch flow passage is used as the cleaning fluid inlet, the flow rate adjusting means 11 in the branch flow passage q is closed and the cleaning fluid is supplied through an opened valve 30. The cleaning fluid then gradually falls down while whirling and cleaning the entire inside of the self-priming water separating chamber e evenly, and when it reaches the opening part m1 of the spouting passage c1 of the smaller volute v1, it proceeds straight into the passage c1, cleaning that passage c1 followed by the smaller volute v1 in a flow sequence opposite to that of the self-priming and the normal pumping operations, whereby the further improved cleaning effect can be obtained.

The valve 30 is closed after the cleaning operation is finished.

The rest of the constitution and functions are the same as those of the thirteenth embodiment.

Fifteenth Embodiment

Figure 19:
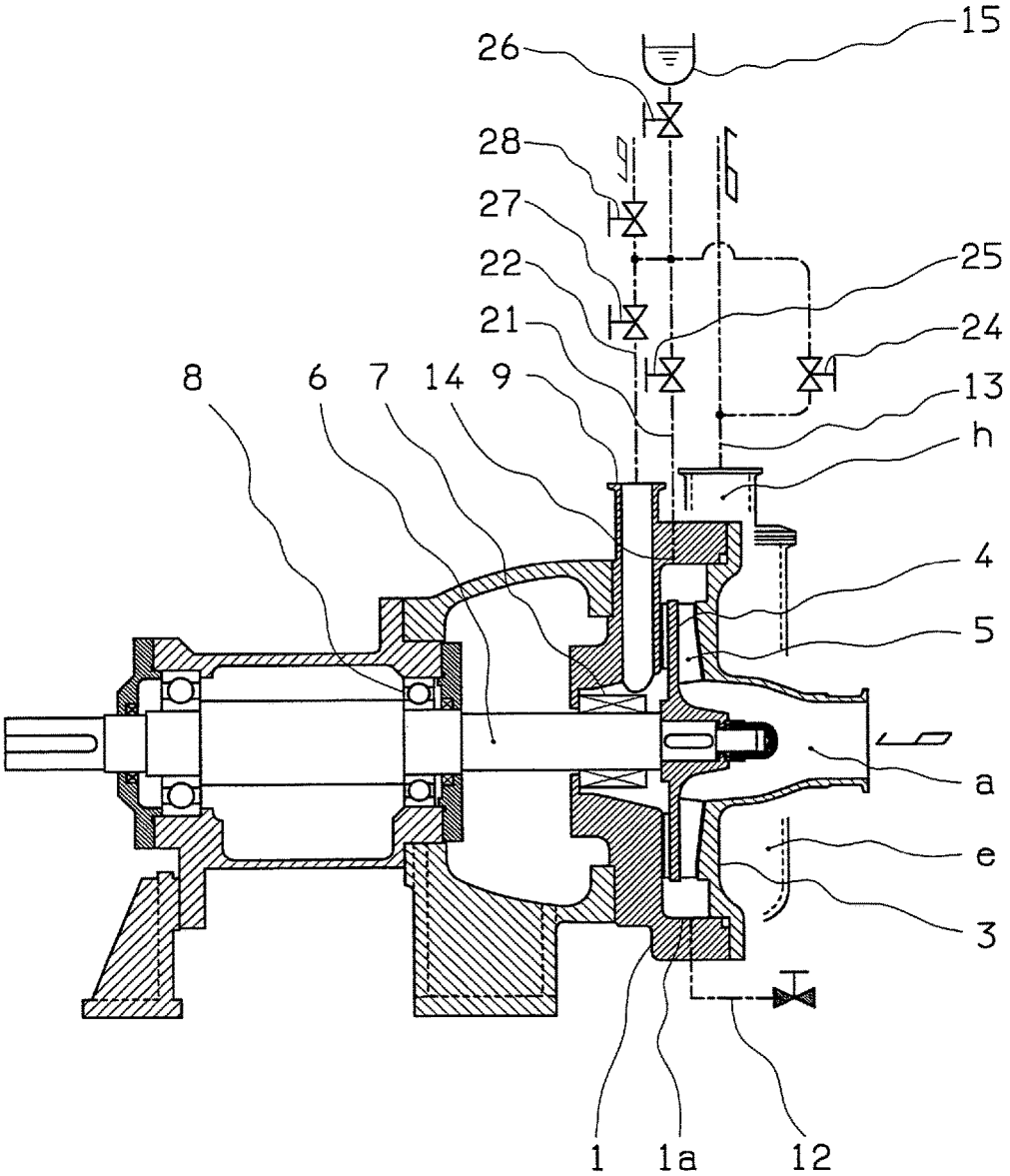
FIG. 19 is a longitudinal sectional view of the fifteenth embodiment of the present invention.

FIG. 19 shows a longitudinal sectional view of the fifteenth embodiment of the present invention.

In this fifteenth embodiment, the cleaning fluid inlet 9 near the shaft sealing part 7 is enabled to communicate with the vicinity of the inner circumference part 1*a* of the casing 1 or with the vicinity of the self-priming water separating chamber e.

The inflow angle and the shape of the flow path of the cleaning fluid inlet 9 toward the interior cavity space in the casing 1, where the shaft sealing part 7 is contained, may be suitably selected, but it is preferable that the flow path of the cleaning fluid inlet 9 is arranged to be winding tangentially into the cavity space, as exemplified in the figure, so that the cleaning fluid spreads into every corner while being whirled in the cavity space.

This cleaning fluid inlet 9 may simply be connected to a supply source of the cleaning fluid, but in order to enhance the automation of operation and labor saving, there is a way that, utilizing a fact that this cleaning fluid inlet 9 is disposed in the low pressure area near the shaft sealing part 7 of the casing 1, this cleaning fluid inlet 9 is made to communicate with the high pressure area such as the area ranging from the outer circumference of the impeller 4 to the inner circumference part 1*a* of the casing 1 or the area ranging from the self-priming water separating chamber e to the discharge passage h, so that a circulating movement of the cleaning fluid is generated. When CIP (Cleaning In Place) is performed, a part of the cleaning fluid pressurized by the impeller 4 is injected to the shaft sealing part 7 through the cleaning fluid inlet 9 by the pressure difference, it is then pressurized again by the impeller 4 and reaches the vicinity of the inner circumference part 1*a* of the casing 1 and the vicinity of the self-priming water separating chamber e, and the repetition of this automatically creates the circulating current of the cleaning fluid inside the casing 1, whereby the further improved cleaning effect in CIP can be obtained.

Therefore, a connection destination of the cleaning fluid inlet 9 may be chosen from the vicinity of the inner circumference part 1*a* of the casing 1, the vicinity of the self-priming water separating chamber e, and a separately provided supply source of the cleaning fluid, and the above possible connection destinations are illustrated all together in FIG. 19 for convenience of explanation. Namely, an opening 14 which functions both as a priming water inlet and as an air vent is provided near the top of the casing 1, a piping 21 is connected to this opening 14, a piping 22 for supplying the cleaning fluid is connected to the cleaning fluid inlet 9, a discharge pipe 13 is connected to the discharge passage h, and valves 24, 25, 26, 27, 28 are inserted in the pipings 13, 21, 22, as illustrated in the figure. When in use, suitable valves are opened leaving the rest closed. For instance, only the valves 25, 27 are opened if the cleaning fluid inlet 9 should communicate with the vicinity of the inner circumference part 1*a* of the casing 1, only the valves 24, 27 are opened if the cleaning fluid inlet 9 should communicate with the self-priming water separating chamber e (or the discharge passage h), and only the valves 28, 27 are opened if the cleaning fluid inlet 9 should communicate with the separately provided supply source of the cleaning fluid. Needless to say, all of these pipings may be installed, or only the specifically required pipings may be installed.

Meantime, as illustrated in the figure, a funnel 15 to receive a priming water may be mounted on the top of the piping connected to the opening 14 because the opening 14 can serve not only as the air vent at the time of checkup, but also as the priming water inlet at the time of initial priming which is required only when the pump is first started on the installation site.

The rest of the constitution and functions are the same as those of the foregoing embodiments.

Sixteenth Embodiment

Figure 20:
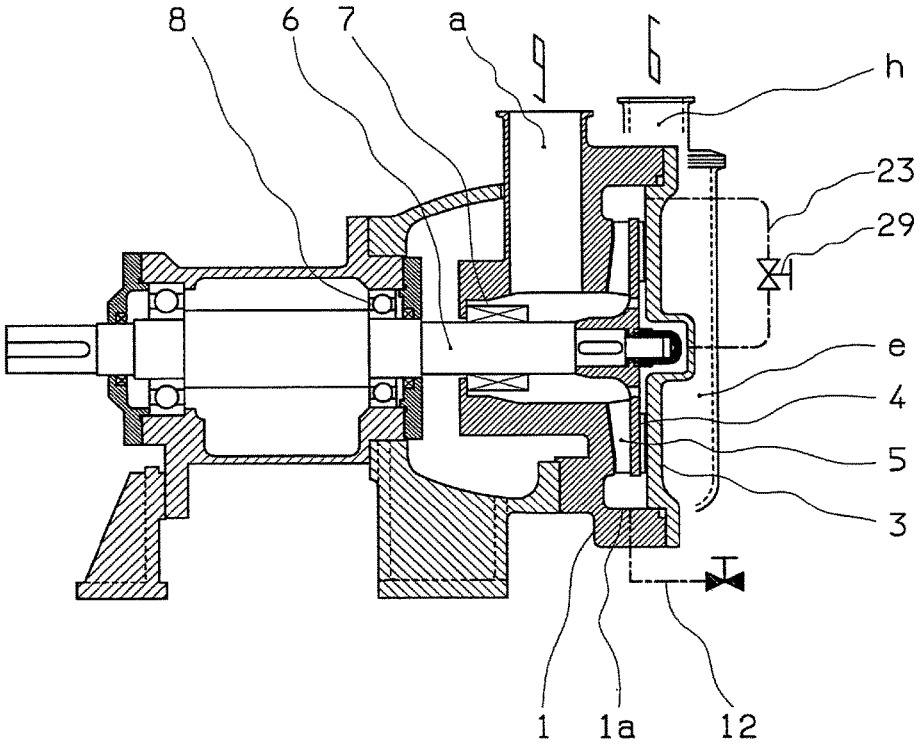
FIG. 20 is a longitudinal sectional view of the sixteenth embodiment of the present invention.

FIG. 20 shows a longitudinal sectional view of the sixteenth embodiment of the present invention.

In this sixteenth embodiment, the pump is configured such that a suction inlet of the pump is disposed at the side of a drive machine (not shown in the figure) when viewed from the side of the impeller 4.

In this case, because not only the discharge pipe but also a suction pipe is mounted on the casing 1, the removal of the suction pipe in disassembly work, which was necessary in the previously described embodiments, is not necessary any more, and when disassembling the pump, all the inside of the pump is exposed only by taking off an inlet cover 3, thus the disassembly and checkup work becomes very easy.

Also, because the inlet passage a is structurally wide and, particularly when the inlet passage a is disposed upright, has a sufficient space for reserving the priming water, it is not necessary to provide any priming water storage tank, or even a priming water storage pipe of an inverse-U shape (i.e., a portion of the suction pipe is raised in a curved section so that the lower end of the cross section of the highest portion of the curved section is at a level nearly equal to or above the upper end of the impeller 4) which will be described in detail later, and thus the installation and the maintenance of the pump are easy.

Meantime, because the shaft sealing part 7 is facing the inlet passage a in this embodiment, it is not necessary to provide such a thing as the cleaning fluid inlet 9 described in the previous embodiments. Instead, because the liquid may stagnate in the vicinity of the center of the inlet cover 3, it is preferable to arrange a piping 23 with a valve 29 between the vicinity of the outer circumference of the impeller 4 and the vicinity of the center of the inlet cover 3 as exemplified in the figure, so that, at the time of CIP (Cleaning In Place) operation, a part of the cleaning fluid pressurized in the pump is injected to the vicinity of the center of the inlet cover 3, automatically generating a circulating current of the cleaning fluid that enhances the cleaning effect of CIP.

The rest of the constitution and functions are the same as those of the foregoing embodiments.

Seventeenth Embodiment

Figure 21:
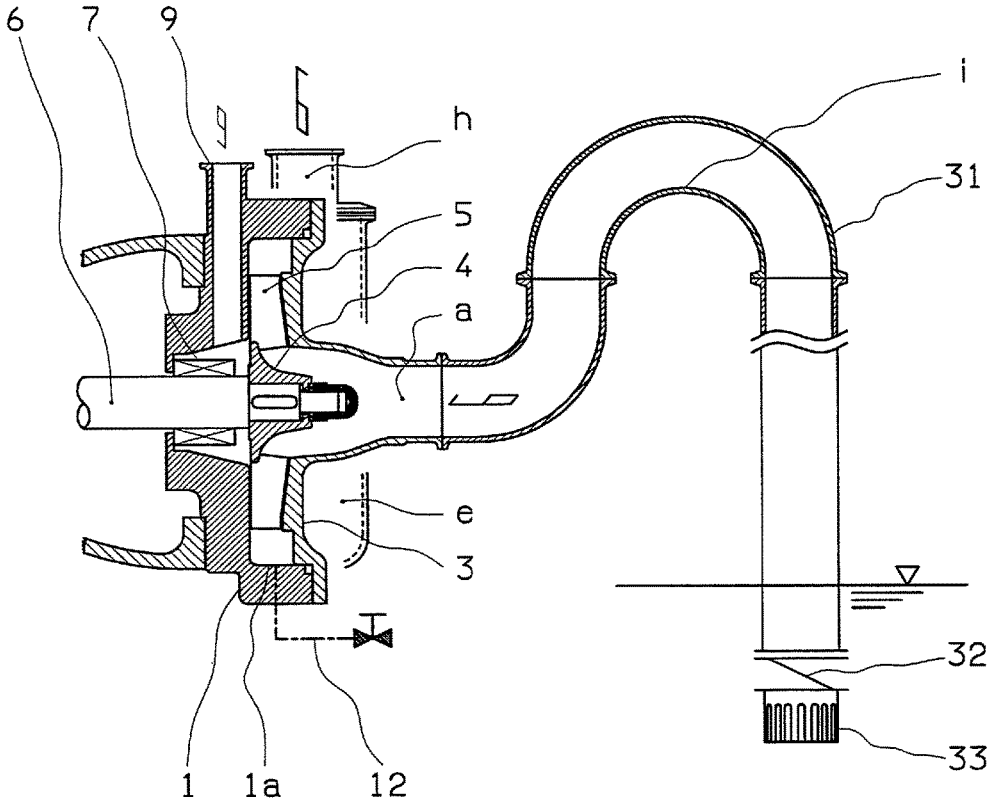
FIG. 21 is a sectional view of a main part of the seventeenth embodiment of the present invention.
Figure 22:
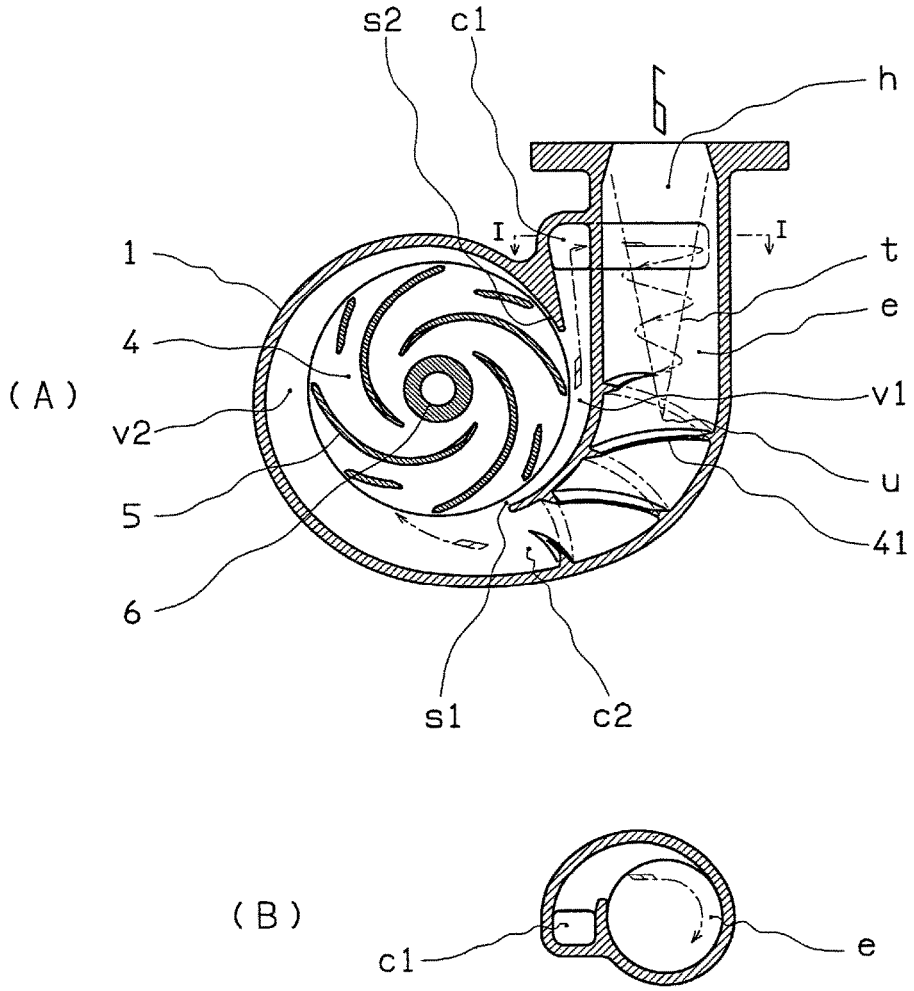
FIG. 22 (A) is a cross-sectional view of an example of the prior art.

FIG. 21 shows a sectional view of a main part of the seventeenth embodiment of the present invention.

This seventeenth embodiment shows one example method to automatically reserve the priming water needed for the self-priming operation, and its configuration is such that a portion of the suction pipe 31 connected to the pump is raised in a curved section so that the lower end i of the cross section of the highest portion of the curved section is at a level nearly equal to or above the upper end of the impeller 4.

By this arrangement, the required water level of the priming water for the self-priming operation of the pump is maintained, and overflow of the priming water through the suction opening when the pump is stopped is prevented.

A component such as a check valve 32 for improving water reserving performance and a strainer 33 for preventing clogging may be installed in the middle or at the end of the suction pipe 31 as exemplified in the figure.

Besides, as exemplified in the figure, the impeller 4 may be an open type impeller which can reduce axial thrust and can improve cleanability.

The rest of the constitution and functions are the same as those of the foregoing embodiments.

Now, technical matters which are common to the respective embodiments will be explained.

The separation positions of the respective connecting parts d1, d2 between the casing 1 and the self-priming water separating chamber e may be suitably selected, and do not have to be restricted to the positions shown in each illustration. Also, the respective separation number may be more than that shown in each illustration if there is no problem when disassembling and cleaning.

For the shape of the impeller 4, various shapes of any known type such as non-clog, open, semi-open, and closed types may be applied, and if the impeller has a shroud, suitable connecting passages or notches which connect the front and back sides of the shroud may be provided. The vane type of the impeller blades 5 may be of any known type, and rear blades may be formed on the back side of the shroud.

The constitution and functions of the self-priming water separating chamber e can be applied to a different type of pump other than the centrifugal pump shown in each embodiment, such as a mixed flow pump, an axial flow pump, and a vortex pump.

The motor, or the drive machine, which rotates the rotating shaft 6 may be suitably selected according to the use condition. For example, if this pump is integrated with a submersible motor using the rotating shaft of the motor as the rotating shaft 6 for this pump, the pump can be made more compact because the bearing part 8 of this pump is unnecessary, and besides, the waterproofing provision during cleaning is unnecessary, and placing this pump with the motor underwater is possible.

To further improve pumping performance (pump head or discharge amount, etc.) of this pump, the casing and the impeller may be provided in a multistage structure, and the multiple pumps may be connected by piping and operated in series or in parallel.

And, the respective constituent members of the present invention can have, within the intended scope of the present invention, design changes such as changes of numbers, positions and combinations of the constituent members, additional uses of conventional art, etc. Furthermore, material qualities of the constituent members may be suitably selected. Thus, the present invention is not limited to the above-described embodiments.

INDUSTRIAL APPLICABILITY OF THE INVENTION

The pump apparatus of the present invention solves the technical problems in the prior art, and provides a self-priming centrifugal pump with enhanced performance and easy operation in a simple mechanism with safe and assured operation, free from restrictions attributable to the quality of a liquid to be pumped and from being blocked, capable of exerting high self-priming performance and high pumping-up performance when being applied to an automatic operative system which handles clean or a high-purity liquid, such as food, pure water, high-purity chemicals or medicinal chemicals, facilitating easy cleaning with CIP (Cleaning In Place) and COP (Cleaning Out of Place) ability that meets sanitary specifications, and enabling application to various kinds of liquids. The practical effects of the implementation of the present invention are very high.

DESCRIPTION OF THE REFERENCE SYMBOLS

1 casing
1*a* inner circumference part of casing
2*a* defining member to define shape of smaller volute
2*b* defining member to define shape of larger volute
3 inlet cover
4 impeller
5 impeller blade
6 rotating shaft
7 shaft sealing part
8 bearing part
9 cleaning fluid inlet
10 cleaning fluid inlet
11 flow rate adjusting means
12 drain
13 discharge pipe
14 opening
15 funnel
21, 22, 23 piping
24, 25, 26, 27, 28, 29 valve
30 valve
31 suction pipe
32 check valve
33 strainer
41 spiral guide
a inlet passage
v1 smaller volute
v2 larger volute
s1 space between outer circumference of impeller and starting end of smaller volute
s2 space between outer circumference of impeller and starting end of larger volute
c1 spouting passage of smaller volute
c2 passage from larger volute
d1 connecting part
d2 connecting part
m1 opening part of spouting passage of smaller volute opened toward self-priming water separating chamber
m2 opening part of passage from larger volute opened toward self-priming water separating chamber
e self-priming water separating chamber
f bottom of self-priming water separating chamber
g lower end of cross section of opening part of passage from larger volute
h discharge passage
i lower end of cross section of highest portion of curved section of suction pipe
p branch point
q branch flow passage
r opening part of branch flow passage opened toward self-priming water separating chamber
t tornado-shaped cavity
u tail bottom of tornado-shaped cavity

What is claimed is:

1. A self-priming centrifugal pump comprising:

a pump casing having a smaller volute and a larger volute;

a space being formed between an outer circumference of an impeller and a starting end of the smaller volute, said space being greater than a space between the outer circumference of the impeller and a starting end of the larger volute, generating a circulating current of self-priming water flowing from the smaller volute to the larger volute;

a diffusing part of the larger volute being formed into an upright, cylindrical self-priming water separating chamber into which the current of the self-priming water from the smaller volute is guided to flow so that air-water separation of the self-priming water is carried out in the self-priming water separating chamber:

characterized in that an inner circumference part of the casing is formed in a circular shape concentric with the outer circumference part of the impeller with a predetermined interval therebetween, and, in the annular space formed between the inner circumference part of the casing and the outer circumference part of the impeller, defining members are disposed on the inner circumference part of the casing so as to be protruded inward toward the vicinity of the outer circumference part of the impeller whereby the defining members define the shapes of the smaller volute and the larger volute; and respective passages from the smaller volute and the larger volute toward the self-priming water separating chamber are respectively separated into connectable members whereby the self-priming water separating chamber is enabled to be attached to and detached from the casing.

2. The self-priming centrifugal pump according to claim 1, wherein an opening part of a spouting passage of the smaller volute, opened toward the self-priming water separating chamber, is formed in a flow path that is drawn tangentially to the inner wall of the self-priming water separating chamber, into the self-priming water separating chamber so that the self-priming water flowing from the smaller volute into that chamber generates a whirling current for centrifugal air-water separation.

3. The self-priming centrifugal pump according to claim 2, wherein an opening part of a passage from the larger volute, opened toward the self-priming water separating chamber, is formed in a flow path that is drawn tangentially to the inner wall of the self-priming water separating chamber, into the self-priming water separating chamber.

4. The self-priming centrifugal pump according to claim 3, wherein the self-priming water separating chamber is formed into a bottomed cylindrical shape, the vicinity of the center of the bottom of that chamber being positioned lower than the lower end of the cross section of the opening part of the passage from the larger volute opened toward the self-priming water separating chamber.

5. The self-priming centrifugal pump according to claim 2, wherein the self-priming water separating chamber is formed into a bottomed cylindrical shape, the vicinity of the center of the bottom of that chamber being positioned lower than the lower end of the cross section of the opening part of the passage from the larger volute opened toward the self-priming water separating chamber.

6. The self-priming centrifugal pump according to claim 5, wherein the self-priming water separating chamber is formed such that its inner wall has no concavo-convex part including a bottleneck, a guide, a baffle plate, and a protrusion.

7. The self-priming centrifugal pump according to claim 2, wherein the self-priming water separating chamber is formed such that its inner wall has no concavo-convex part including a bottleneck, a guide, a baffle plate, and a protrusion.

8. The self-priming centrifugal pump according to claim 2, wherein the self-priming water flowing from the smaller volute is partially branched before reaching the opening part of the spouting passage of the smaller volute, this branched flow flowing out into the self-priming water separating chamber through an opening part of a branch flow passage separately provided at a height position equal to or higher than that of the opening part of the spouting passage of the smaller volute.

9. The self-priming centrifugal pump according to claim 8, wherein a flow rate of the partially branched flow of the self-priming water flowing from the smaller volute is made adjustable.

10. The self-priming centrifugal pump according to claim 8, wherein an outflow direction of the branched flow flowing out into the self-priming water separating chamber through the opening part of the branch flow passage is set so as to suppress the whirling motion of the self-priming water flowing out into the self-priming water separating chamber through the opening part of the spouting passage of the smaller volute.

11. The self-priming centrifugal pump according to claim 2, wherein the self-priming water separating chamber is formed such that its inner wall is not constant in the dimension of a diameter.

12. The self-priming centrifugal pump according to claim 2, wherein a cleaning fluid inlet is provided on the upper part of the self-priming water separating chamber.

13. The self-priming centrifugal pump according to claim 2, wherein a cleaning fluid inlet is provided near a shaft sealing part of the casing where a rotating shaft of the impeller penetrates.

14. The self-priming centrifugal pump according to claim 13, wherein the cleaning fluid inlet near the shaft sealing part of the casing is enabled to communicate with the vicinity of the inner circumference part of the casing or with the vicinity of the self-priming water separating chamber.

15. The self-priming centrifugal pump according to claim 2, wherein a reduced diameter part is provided in a discharge passage of the self-priming water separating chamber.

16. The self-priming centrifugal pump according to claim 2, wherein the suction inlet of the pump is configured such that a portion of a suction pipe connected to the pump is raised in a curved section so that the lower end of the cross section of the highest portion of the curved section is at a level equal to or above the upper end of the impeller.

17. The self-priming centrifugal pump according to claim 1, wherein a reduced diameter part is provided in a discharge passage of the self-priming water separating chamber.

18. The self-priming centrifugal pump according to claim 1, wherein the pump is configured such that a suction inlet of the pump is disposed at the side of a drive machine when viewed from the side of the impeller.

19. The self-priming centrifugal pump according to claim 1, wherein the suction inlet of the pump is configured such that a portion of a suction pipe connected to the pump is raised in a curved section so that the lower end of the cross section of the highest portion of the curved section is at a level equal to or above the upper end of the impeller.

20. The self-priming centrifugal pump according to claim 1, wherein a cleaning fluid inlet is provided near a shaft sealing part of the casing where a rotating shaft of the impeller penetrates.

* * * * *